US006050010A

United States Patent [19]

Garcia et al.

[11] Patent Number: 6,050,010

[45] Date of Patent: Apr. 18, 2000

[54] INTERNALLY ILLUMINATABLE CARD AND LIGHTER

[75] Inventors: Raymond J. Garcia, Playa del Ray; David E. Gerry, La Jolla; John McMahon, Mission Viejo; John Nakama, Los Angeles, all of Calif.

[73] Assignee: Lightworks JRJ Enterprises, Inc., Beverly Hills, Calif.

[21] Appl. No.: 09/053,424

[22] Filed: Apr. 1, 1998

[51] Int. Cl.[7] ..... G09F 13/22

[52] U.S. Cl. ..... 40/124.02; 40/544

[58] Field of Search ..... 40/124.02, 124.06, 40/124.191, 442, 544; 200/51 R, 51.09; 439/188

[56] References Cited

U.S. PATENT DOCUMENTS

| | | | |
|---|---|---|---|
| 4,999,936 | 3/1991 | Calamia et al. | 40/544 |
| 5,245,516 | 9/1993 | de Haas et al. . | |
| 5,259,778 | 11/1993 | Zhang | 439/188 |
| 5,471,773 | 12/1995 | Hoffman | 40/544 |
| 5,533,289 | 7/1996 | Hoffman | 40/544 |
| 5,621,991 | 4/1997 | Gustafson | 40/544 |

*Primary Examiner*—Joanne Silbermann
*Attorney, Agent, or Firm*—Faegre & Benson LLP

[57] ABSTRACT

An internally illuminatable card having an electroluminescent panel, an image overlay on at least one surface of the electroluminescent panel, and a plurality of power contacts in electrical communication with the electroluminescent panel and accessible through at least one surface of the card, and a card lighter wherein electrical energy sufficient to illuminate the electroluminescent panel is selectively coupled to the electroluminescent panel via the power contacts upon energization by the card switch terminal occurring after contact is established between the power contacts and the card lighter. The card lighter includes a housing, a power supply, a plurality of lighter contacts, and a delay mechanism for reducing arcing when the card is inserted into the card lighter. The power supply can be adapted so as to cause a card inserted into the lighter to flash or to cause the hue and intensity of the light emitted from the inserted card to alternate between two states.

15 Claims, 28 Drawing Sheets

INTERNALLY ILLUMINATABLE CARD AND LIGHTER

BACKGROUND OF THE INVENTION

1. Field of the Invention

The present invention relates generally to electroluminescent panels. In particular, the present invention is an internally illuminatable card and lighter in which an image on a surface of an electroluminescent panel is illuminated when the internally illuminatable card is inserted into a lighter.

2. Description of the Related Art

Collector's cards (also referred to as trading cards, the originals of which were baseball cards) are well known in the art. A collector's card typically includes a thin, generally rectangular, planar sheet of cardboard having one or more surfaces on which an image or text is affixed. For example, sports collector's cards typically have a width of about 2.5 inches and a length of about 3.5 inches. A picture of an athlete is typically affixed to one side of the sports collector's card and text describing the athlete is affixed to the other side of the card. Sports collector's cards are commercially available for a wide variety of sports including baseball, football, basketball, hockey, and soccer. Other types of collector's cards feature, for example, pictures and/or textual descriptions of scenes and characters from films and television shows.

Collector's cards are usually sold as a part of a series of collector's cards in which each card in the series has different images or text. Many collectors purchase several cards from a given series and often treat the cards as investments, the value of which the collectors hope will increase over time. However, the value of a collector's card is determined in part by the condition of the card. A card that is worn or damaged is less valuable than a card that is in "mint" condition (i.e., substantially the same condition as when the card was first manufactured). Also, to help verify the authenticity of a potentially valuable card, some collector's cards include some type of authenticating means (e.g., a holographic image).

Prior art collector's cards, however, have limitations. Conventional collector's cards are not internally illuminatable. In other words, conventional collector's cards do not include their own light source. Instead, conventional collector's cards reflect ambient light, and, as a result, are generally viewable only in well-lit areas. Also, the range of visual effects that can be created in a conventional card is limited to the effects that can be created with reflected ambient light.

The use of electroluminescent ("EL") panels as a source of light is well known. For example, U.S. Pat. No. 4,999,936, issued to Calamia et al., describes a typical EL panel formed from a laminate structure. The EL panel structure includes a flexible, non-conductive substrate on which a thin conductive layer (e.g., copper or aluminum) is formed by a deposition process. A phosphor coating is applied to a surface of the thin conductive layer. A transparent conductive layer is then applied on top of the phosphor coating. The phosphor coating can be made to produce light by exciting the phosphor film with an oscillating electrical voltage (e.g., a 120 V, 400 Hz AC voltage) applied across the two conductive layers. The oscillating voltage used to drive the EL panel is typically produced by an inverter which provides an AC voltage from a DC power supply.

Prior art EL devices, however, are not suitable for use as collector's cards. Collectors expect collector's cards to have physical dimensions similar to the physical dimensions of conventional collector's cards. Therefore, conventional EL devices that include an inverter, a battery, and an EL panel in a single device are too bulky to be used as collector's cards. Moreover, simply removing the EL panel from a conventional EL device to form a collector's card would also not be commercially viable. Conventional EL devices that were designed assuming that the EL panel would be fixedly attached to the output terminals of the inverter before a voltage is developed across the inverter output terminals typically do not include any means for reducing arcing that would likely occur if the EL panel was connected to, or removed from, the inverter output terminals while a voltage existed across the inverter output terminals. Arcing is undesirable as it appears dangerous to consumers. Also, arcing eventually can damage the EL panel electrodes and the inverter output terminals, as well as cause carbon buildup on the card's terminals, which, if part of a card that is viewed as an investment, could decrease the value of the investment.

The present invention addresses these needs by providing an internally illuminatable collector's card fabricated with the physical dimensions of a conventional collector's card and a lighter to illuminate the card with reduced arcing.

SUMMARY OF THE INVENTION

The present invention is an internally illuminatable card and lighter that are adapted to illuminate an image overlay on one or more surfaces of an electroluminescent panel with reduced arcing.

One embodiment of an internally illuminatable card according to the present invention includes an electroluminescent panel, an image overlay on at least one surface of the electroluminescent panel, a plurality of power contacts in electrical communication with the electroluminescent panel and located on the card so that electrical energy sufficient to illuminate the electroluminescent panel can be selectively coupled to the electroluminescent panel.

One embodiment of a card lighter according to the present invention includes a housing shaped to receive and support an internally illuminatable card so that at least one surface of the card is viewable, a power supply circuit located within the housing and adapted to supply to the card electrical energy sufficient to illuminate the card, a plurality of lighter contacts in electrical communication with the power supply circuit and operationally disposed within the housing so that the lighter contacts can be made to come into contact with corresponding power contacts on the card in order to establish a first electrical connection between the power supply circuit and the card, and a delay mechanism located within the housing and in electrical communication with the power supply circuit and the lighter contacts. The delay mechanism is adapted to complete an electrical circuit between the power supply circuit and the card sometime after the first electrical connection has been established when the card is inserted into the lighter and to break the electrical circuit between the power supply circuit and the card sometime before the first electrical connection is broken when the card is removed from the lighter so as to reduce arcing.

DETAILED DESCRIPTION

Figure 1:
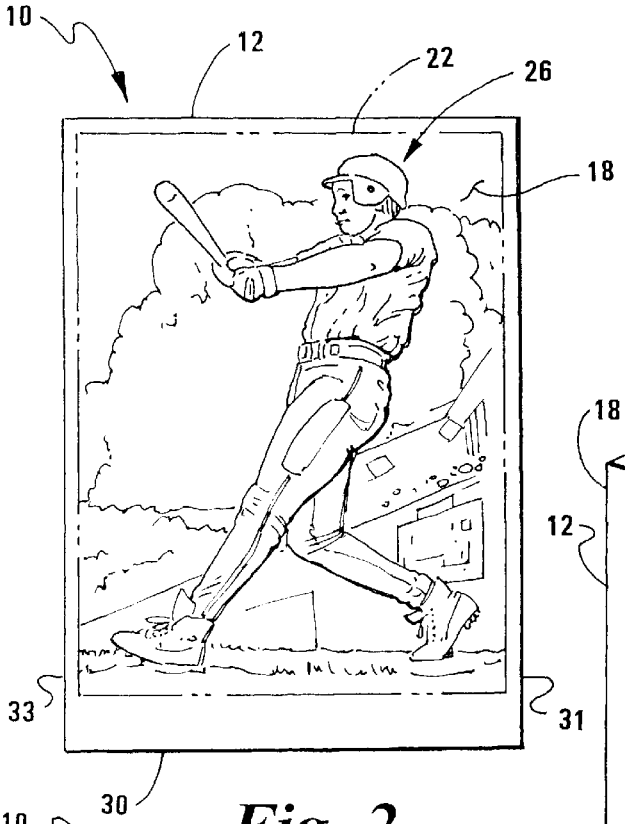
FIG. 1 is a front view of an internally illuminatable card having an image on one surface of the card.
Figure 2:
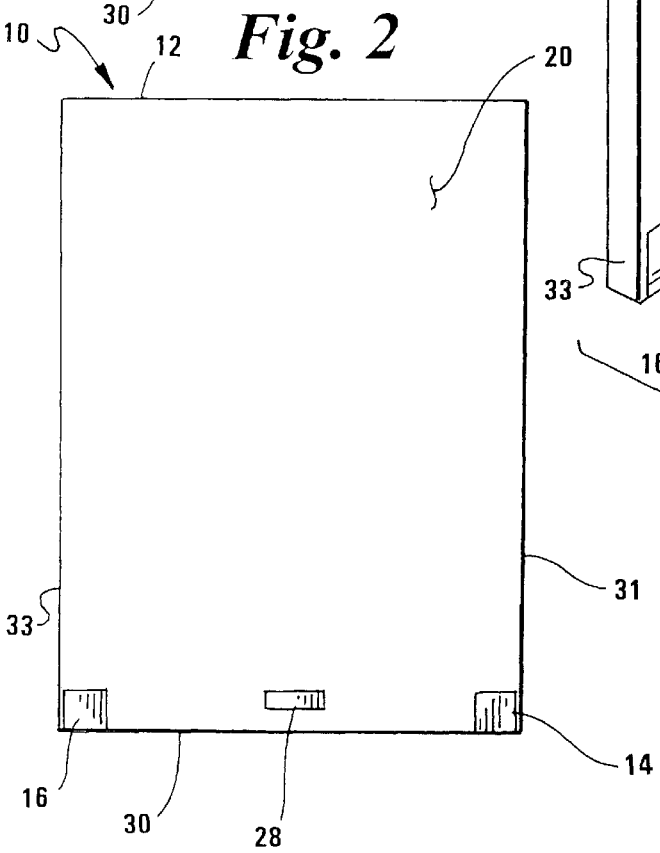
FIG. 2 is a back view of the internally illuminatable card shown in FIG. 1.
Figure 3:
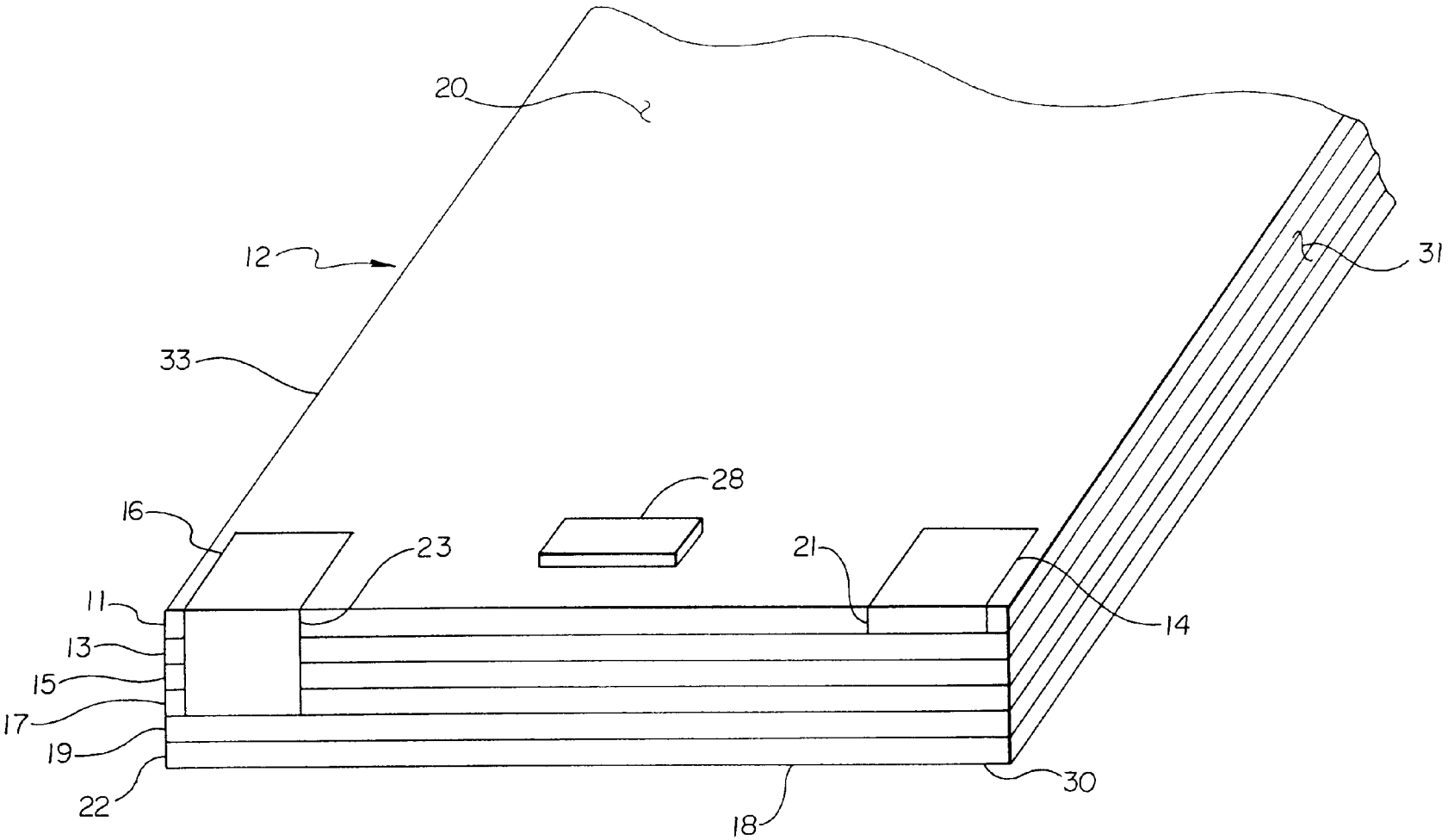
FIG. 3 is a perspective view of a bottom edge of the internally illuminatable card shown in FIGS. 1–2.

FIGS. 1–4 show an internally illuminatable card 10 in accordance with the present invention. The card 10 has first and second surfaces 18 and 20 and includes a generally planar electroluminescent ("EL") panel 12 of conventional design. As shown in FIG. 3, the EL panel 12 typically is a flexible, laminate structure having a non-conductive rear insulator layer 11 on which a rear electrode layer 13 is formed. A dielectric layer 15 is formed on a surface of layer 13, and a phosphor layer 17 is applied to a surface of the dielectric layer 15. A surface of the phosphor layer 17 is covered with a transparent, front conductor layer 19. The phosphor layer 17 can be made to produce light by stimulation of the phosphor layer 17 with an oscillating electrical voltage (e.g., a 120 V, 400 Hz AC voltage) applied across the rear conductor layer 13 and the front conductor layer 19. The layers of the EL panel 12 are shown in FIG. 3 with their thicknesses exaggerated for purposes of illustration. The EL panel 12 is shown in FIGS. 1–4 having a rectangular shape similar to that of a conventional sports collector's card (e.g., about 2.5 inches wide by about 3.5 inches long by about 0.04 inches thick), although the EL panel 12 could be formed in other shapes such as other rectangles (e.g., the shape of a conventional business card), squares, circles, or triangles.

At least one image overlay 22 is viewable from at least one of the first and second surfaces 18 and 20 of the card 10. The image overlay 22 contains pictures and/or text appealing to collectors of the card 10. For example, in a baseball-oriented card 10, the image overlay 22 contains a picture 26 of a baseball player and is affixed to the transparent, front conductor layer 19 of the EL panel 12. Additionally, a second image overlay (not shown) could be attached to the rear insulator layer 11, although in such an embodiment the second image overlay would not be illuminated. In order for a second image overlay to be illuminated, a second rear conductor layer, a second dielectric layer, a second phosphor layer, and a second transparent, front conductor layer would need to be formed on the free surface of the rear insulator layer 11. In such an alternative embodiment, the second image overlay could be formed on the second transparent front conductor layer and illuminated by stimulation of the second phosphor layer. The image overlay 22 includes a clear or translucent sheet (preferably made from acetate) on which pictures or text is printed using conventional color and/or black and white printing techniques. The image overlay 22 is adhesively attached to the EL panel 12 using a conventional adhesive. Also, the image overlay 22 can be formed as a "crack-and-peel" sticker with an adhesive pre-applied to a surface of the image overlay 22. The pre-applied adhesive is covered with a removable, non-stick backing until it is time to apply the image overlay 22 to the EL panel 12. At application time, the backing is removed from the sticker which exposes the adhesive and allows the image overlay 22 to be attached to the EL panel 12. Alternatively, the image overlay 22 can be formed directly on the EL panel 12 by printing the image or text on transparent, front conductor layer 19. Yet another alternative is to sputter an image directly in the phosphor layer 17 of the EL panel 12 so that the image is formed integrally with the phosphor layer 17.

Figure 4:
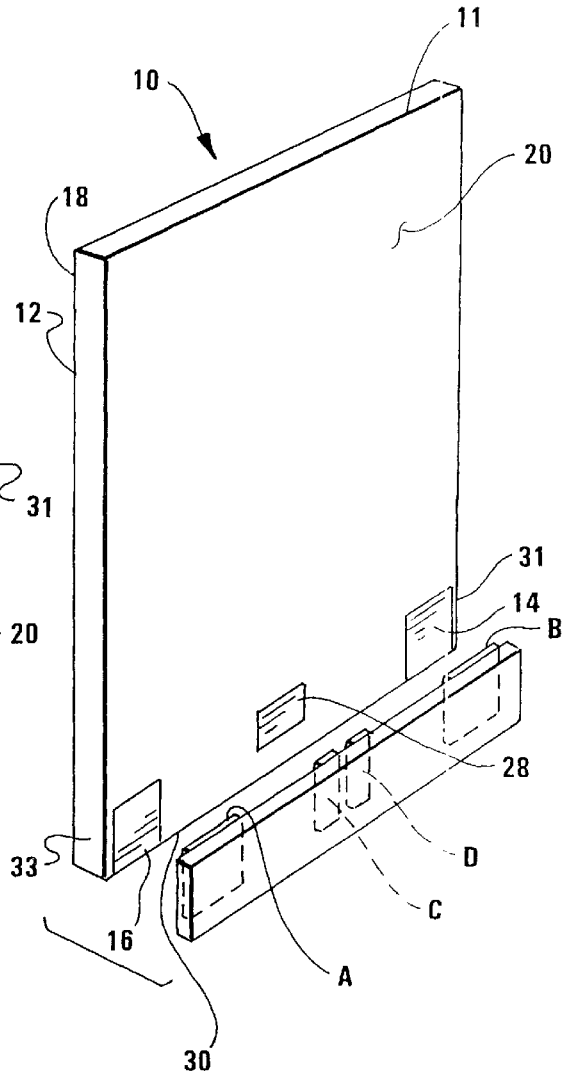
FIG. 4 is a perspective view of the internally illuminatable card shown in FIGS. 1–3 along with corresponding contacts from a lighter.

As shown in FIGS. 2–4, the card 10 has power contacts 14 and 16 formed in the EL panel 12 of the card 10 that are accessible from the second surface 20 of the card 10. Power contact 14 is in electrical communication with the rear conductor layer 13, and power contact 16 is in electrical communication with the transparent, front conductor layer 19. Recesses 21 and 23 are formed in the laminate structure of the EL panel 12 so that the power contacts 14 and 16 may contact the conductor layer 13 and 19, respectively. The power contacts 14 and 16 are formed from a conductive material (such as silver, copper, or gold). The power contacts 14 and 16 are used for coupling AC electrical energy to the phosphor layer 17 in order to illuminate the EL panel 12. Generally, the power contacts 14 and 16 can be located anywhere on the first and/or second surfaces 18 and 20 of the card 10. However, the power contacts 14 and 16 should be arranged on the card 10 in locations allowing the power contacts 14 and 16 to come into contact with corresponding lighter contacts in a card lighter designed to illuminate the card 10 by coupling AC electrical energy to the EL panel 12 through the power contacts 14 and 16. Also, the power contacts 14 and 16 are preferably located so as not to unduly interfere with the aesthetics of the card 10. In FIGS. 2–4, the power contacts 14 and 16 are positioned adjacent to a bottom edge 30 of the EL panel 12 with contact 14 immediately adjacent to a first lateral side 31 and contact 16 immediately adjacent to a second lateral side 33. The locations of the power contacts 14 and 16, as shown in FIG. 4, allow the power contacts 14 and 16 to come into electrical contact with corresponding contacts (A and B in FIG. 4) from a card lighter designed to illuminate the card 10. EL panels with power contacts suitable for use in the internally illuminatable card 10 are commercially available from Durel Corporation of Chandler, Ariz. Alternatively, the power contacts 14 and 16 can, rather than being recessed onto the card, be located on portions of the conductive layers 13 and 19 of the EL panel laminate structure that protrude from an edge of the EL panel 12 or are made accessible through pins or rivets composed of a conductive material, preferably aluminum, crimped or soldered onto the EL panel 12 so that the pins or rivets are in electrical communication with the conductive layers 13 and 19 of the EL panel 12. Also, it is to be understood that a second pair of AC power contacts can be formed on surface 18 in a similar manner in order, for example, to allow the card 10 to be inserted into a card lighter and illuminated with either of surfaces 18 or 20 facing the user.

As shown in FIGS. 2–4, the internally illuminatable card 10 can further include a card switch terminal 28 located on the second surface 20 of the card 10. It is to be understood, however, that the card 10 can be formed with any number (including one or zero) of card switch terminals located on the surfaces 18 or 20, or both. The card switch terminals can be located anywhere on the surfaces 18 or 20 of the card 10, but should generally be positioned to allow the card switch terminals to come into electrical contact with corresponding lighter switch terminals in a card lighter designed to illuminate the card 10. Also, the card switch terminal 28 is preferably located so as not to unduly interfere with the aesthetics of the card 10. In the embodiment shown in FIGS. 1–4, the card switch terminal 28 is located on the surface 20 in a position corresponding to lighter switch terminals C and D (shown in FIG. 4). The card switch terminal 28 is located farther from the bottom edge 30 than the power contacts 14 and 16. The card switch terminal 28 is a relatively thin island of conductive material (such as bronze, silver, or gold) formed using conventional plating techniques and is electrically insulated from the power contacts 14 and 16 and the conductor layers 13 and 19 and the phosphor layer 17. Alternatively, the card switch terminal 28 can be formed so as to protrude from an edge of the EL panel 12.

Figure 5:
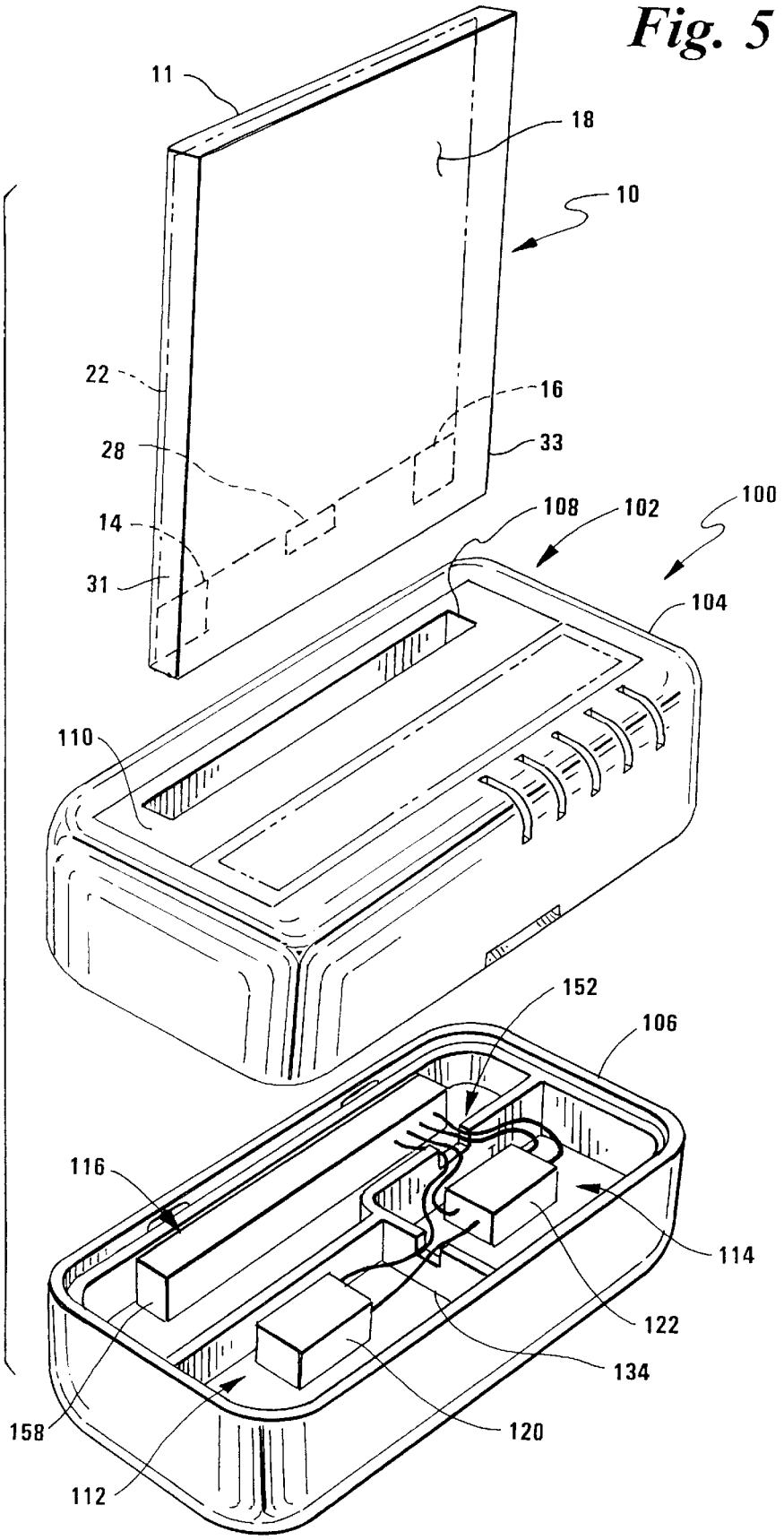
FIG. 5 is a perspective view of an internally illuminatable card and a card lighter with the cover displaced to show certain internal details thereof.
Figure 6:
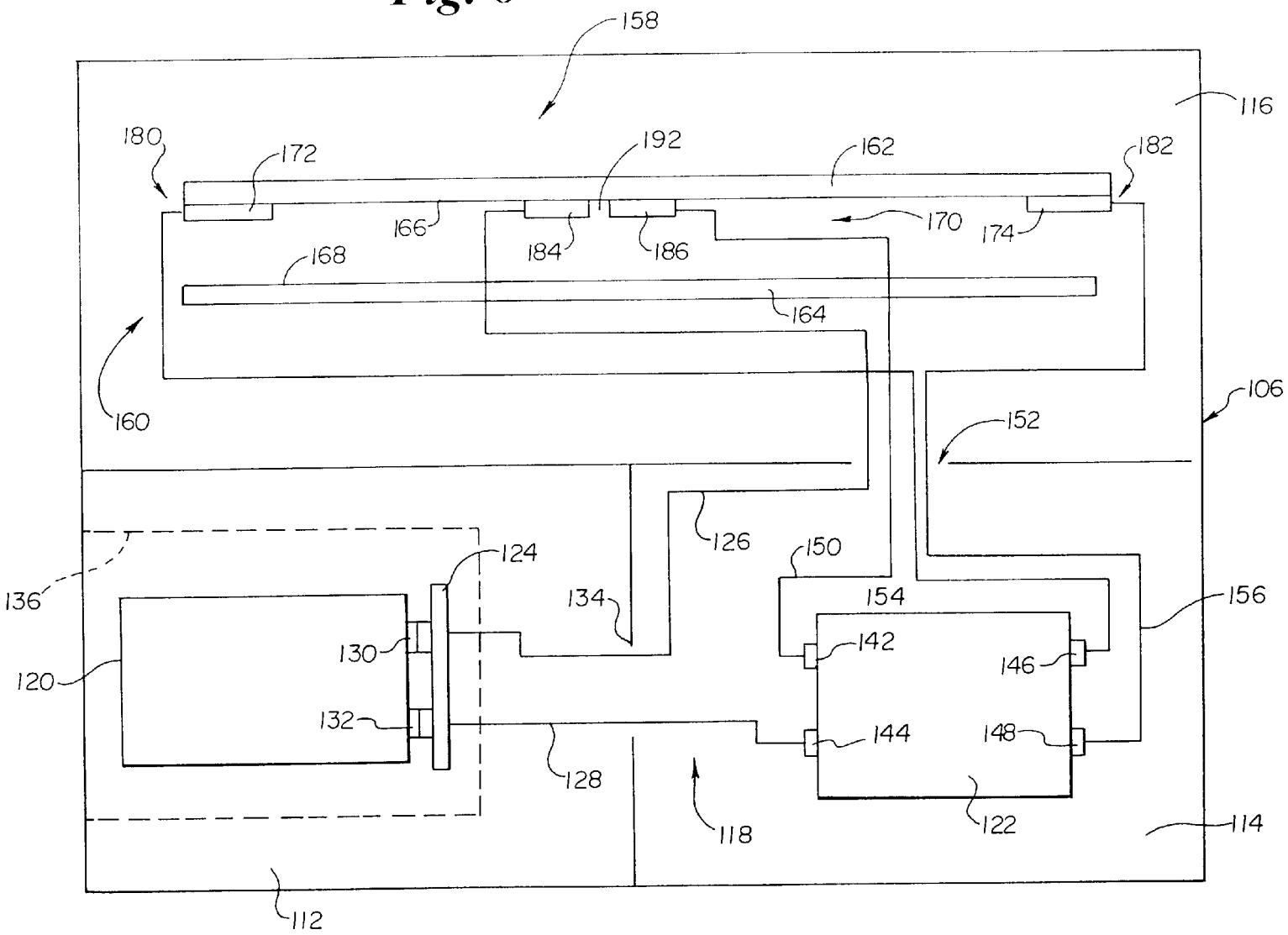
FIG. 6 is a layout diagram of a card lighter according to a first embodiment of the present invention.
Figure 7:
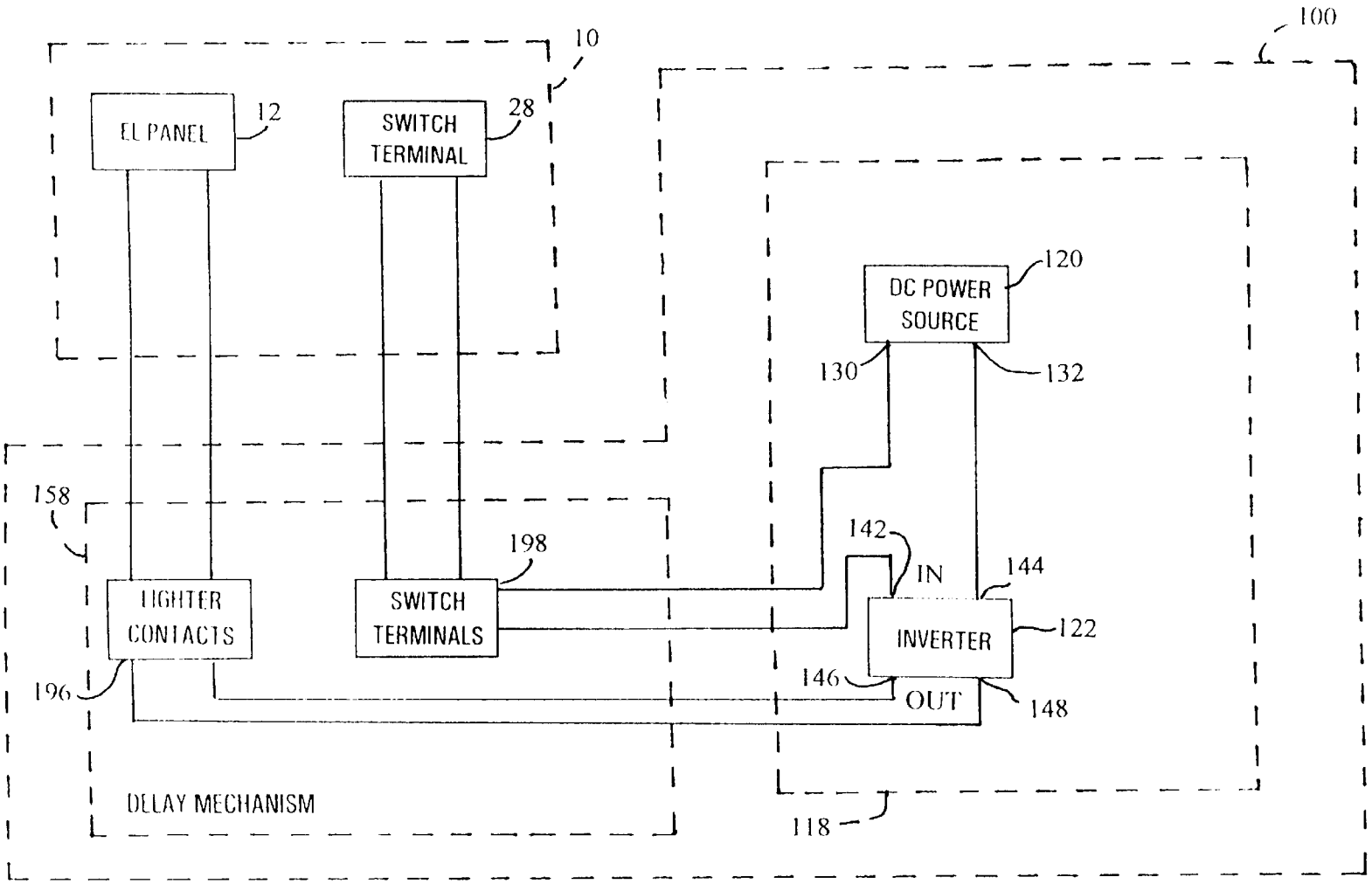
FIG. 7 is a block diagram of the card lighter shown in FIG. 6 connected to an internally illuminatable card according to the present invention.

FIGS. 5–7 show a card lighter 100 designed to illuminate the card 10. The card lighter 100 includes a housing 102 that is formed from upper and lower housing pieces 104 and 106 that are made of plastic using conventional plastic fabrication techniques such as injection molding. Preferably, the housing 102 is 4.125 inches long, 2.375 inches wide, and 1.125 inches tall. The upper housing piece 104 is attached to the lower housing piece 106 to form the housing 102 by conventional fastening means such as a plurality of tamper-resistant screws (not shown). A slot 108 is formed in a surface 110 of the upper housing piece 104 and has a shape that will allow a portion of the card 10 to pass through the slot 108 and into the housing 102. For example, for a card 10 that is 2.5 inches wide, the slot 108 should be at least that wide, and preferably slightly greater.

The interior of the lower housing piece 106 is divided into a battery chamber 112, an inverter chamber 114, and a card chamber 116. As shown in FIG. 6, the battery chamber 112 and the inverter chamber 114 house a power supply circuit 118 that includes a battery 120 and an inverter 122. The battery 120 is housed in the battery chamber 112 and serves as a DC power source for the power supply circuit 118. The battery 120, preferably, is a conventional 9 V battery capable of providing 580 milliamp hours, although it is to be understood that the battery 120 can be any DC power source, e.g., the DC output of a conventional AC voltage rectifier plugged into an AC power outlet. A conventional 9 V battery clip 124 attaches conventional wires 126 and 128 to positive and negative terminals 130 and 132, respectively, of the battery 120. The wires 126 and 128 pass out of the battery chamber 112 into the inverter chamber 114 through a slit 134 formed in the wall separating the battery chamber 112 from the inverter chamber 114. The battery chamber 112 further includes a slide-off battery access panel 136 that can be removed from a wall of the housing 102 to allow the battery 120 to be inserted into or removed from the battery chamber 112. A first foam strip (not shown) is attached to the inside surface of the access panel 136 to hold the battery 120 in place when the access panel 136 is attached to the housing 102.

Alternatively, the power supply circuit 118 could be adapted so as to selectably provide DC power from either a battery 120 or the DC output of a conventional transformer plugged into a conventional AC outlet. In such an embodiment (not shown), a conventional DC power jack, such as part number PJ-005A commercially available from CUI Stack of Beaverton, Oreg. is located within and is made accessible through the housing 102 so that a DC output plug from a conventional wall transformer, such as part number DPD090020-P-5 commercially available from CUI Stack, can be inserted into the DC power jack. When the output plug of the transformer is not inserted into the DC power jack, the DC power jack establishes electrical connections between the positive and negative terminals 130 and 132 of the battery 120 and the wires 126 and 128, respectively, so that the battery 120 supplies the DC power to the card lighter 100. When the output plug of the transformer is inserted into the DC power jack, the DC power jack breaks the electrical connections between the positive and negative terminals 130 and 132 of the battery 120 and the wires 126 and 128, respectively, and establishes electrical connections between positive and negative DC outputs of the wall transformer and the wires 126 and 128, respectively, so that the DC output of the wall transformer supplies the DC power to the card lighter 100 instead of the battery 120.

The inverter chamber 114 houses the inverter 122 atop a second foam strip (not shown) which holds the inverter 122 in place. The inverter 122 is of conventional design and takes the DC electrical energy from the battery 120 and converts it to an AC electrical energy sufficient to drive the EL panel 12. In the preferred embodiment, the inverter 122 takes the 9 V DC input from the battery 120 and outputs a 120 V, 400 Hz AC signal at 38 milliamps. It is to be understood that by varying the output frequency of the inverter 122, both the intensity and the color of the light emitted from the EL panel 12 can be varied. Changing the output frequency of the inverter 122 from 400 Hz to 1000 Hz (e.g., by varying the ratio of primary coil windings to secondary coil windings in the inverter 122 from 0.356:1 to 0.879:1) changes the hue of the color of the light emitted from the EL panel 12 from a green to a blue. However, changing this same frequency from 400 Hz to 440 Hz will simply change the intensity of the green light emitted from a dimmer level to a brighter level. Generally the range of inverter frequencies is from about 60 Hz to about 5,000 Hz. A suitable inverter 122 is the Model No. VL 109-4-1-L-5DU (Input 9 DC, Output 120 VAC 400 Hz) transformer-based inverter available from Sigmatron, Inc., of Elk Grove Village, Ill. The inverter 122 has positive and negative inputs 142 and 144 for electrically coupling the DC electrical energy from the battery 120 to the inverter 122 and first and second outputs 146 and 148 for coupling the AC electrical energy to the EL panel 12. The wire 128 from the negative terminal 132 of the battery 120 is attached to the negative input 144 of the inverter 122. A wire 150 is connected at one end to the positive input 142 of the inverter 122 and passes through a second slit 152 formed in the wall separating the inverter chamber 114 from the card chamber 116. The wire 126 that is attached to the positive terminal 130 of the battery 120 also exits the inverter chamber 114 through the second slit 152 into the card chamber 116. Moreover, AC wires 154 and 156 are connected at one end to the first and second outputs 146 and 148, respectively, of the inverter 122 and pass out of the inverter chamber 114 into the card chamber 116 through slit 152.

The card chamber 116 of the lower housing piece 106 is generally located beneath the slot 108 in the upper housing piece 104. A delay mechanism 158 is preferably located in the card chamber 116 and establishes a first electrical connection between the AC wires 154 and 156 (and the inverter outputs 146 and 148) and the power contacts 14 and 16 of the card 10 before a second electrical connection between the positive terminal 130 of the battery 120 and the positive input 142 of the inverter 122 is established and breaks the second electrical connection before the first electrical connection is broken. The delay mechanism 158 reduces arcing at the power contacts 14 and 16 of the card 10 because when the first electrical connection is established, there is no AC voltage developed across the AC wires 154 and 156 due to an open circuit between the positive terminal 130 of the battery 120 and the positive input 142 of the inverter 122. The second electrical connection closes the open circuit and allows DC electrical energy to be input to the inverter 122 so that an AC voltage sufficient to drive the EL panel 12 can be developed across the inverter outputs 146 and 148 and, as a result of the first electrical connection, power contacts 14 and 16. Moreover, the delay mechanism 158 reduces arcing at the power contacts 14 and 16 because when the first electrical connection is broken, there is no AC voltage developed across the AC wires 154 and 156 due to the open circuit between the positive terminal 130 of the battery 120 and the positive input 142 of the inverter 122 that results from the second electrical connection being broken before the first electrical connection is broken.

As shown in FIG. 6, the delay mechanism 158 includes a contact holder 160 having two elongated, planar sheets 162 and 164 formed from a relatively light, flexible, and electrically insulating material, preferably a conventional form of durable plastic. The two sheets 162 and 164 are arranged generally parallel to each other with a face 166 of sheet 162 facing a face 168 of sheet 164. An elongated slit 170 separates faces 166 and 168 from each other. The sheets 162 and 164 are arranged within the card chamber 116 so that the slit 170 is underneath the slot 108 with the longitudinal and lateral axes of the slit 170 aligned with the longitudinal and lateral axes of the slot 108 so that when a portion of the card 10 is inserted through the slot 108 into the card chamber 116, the portion of the card 10 will be sandwiched between sheets 162 and 164 so that faces 166 and 168 are in physical contact with the first and second surfaces 18 and 20 of the card 10.

The delay mechanism 158 has a pair 196 of lighter contacts 172 and 174 located on the face 166. The lighter contacts 172 and 174 are islands of conductive material, preferably a metal such as silver, that are applied to face 166 using conventional techniques. The lighter contacts 172 and 174 are arranged on the face 166 in a position that allows the lighter contacts 172 and 174 to touch the power contacts 14 and 16, respectively, when the bottom 30 of the card 10 is inserted through slot 108 into the housing 102 with the surface 20 facing the sheet 162. To accommodate the arrangement of the power contacts 14 and 16 on the card 10 shown in FIGS. 1–4, the lighter contact 172 is arranged immediately adjacent to a first lateral edge 180 of the contact holder 160 and the lighter contact 174 is immediately adjacent a second lateral edge 182 of the holder 160. The AC wire 154 is electrically connected to lighter contact 172 and the AC wire 156 is electrically connected to lighter contact 174. The first electrical connection between the inverter outputs 146 and 148 and the power contacts 14 and 16 can be established, for example, by inserting the bottom edge 30 of the card 10 into the slot 108 with the surface 20 facing sheet 162 and having the power contacts 14 and 16 touch the lighter contacts 172 and 174, respectively.

The delay mechanism 158 also has a pair 198 of lighter switch terminals 184 and 186 located on the face 166. The lighter switch terminals 184 and 186 are islands of conductive material, preferably a metal such as copper, that are applied to the face 166 using conventional techniques. The lighter switch terminals 184 and 186 are arranged on the face 166 in positions that allow the lighter switch terminals 184 and 186 to touch the card switch terminal 28 when the bottom 30 of the card 10 is inserted through the slot 108 into the housing 102 with the surface 20 facing the sheet 162. The card lighter 100 shown in FIGS. 5–7 is designed to receive the card 10 shown in FIGS. 1–4 with the card switch terminal 28 located on surface 20 adjacent to the bottom 30 of the card 10 and centered in between the power contacts 14 and 16. To accommodate the location of the card switch terminal 28 on the card 10 shown in FIGS. 1–4, the lighter switch terminals 184 and 186 are centered in between lighter contacts 172 and 174 with a space 192 separating and electrically isolating terminal 184 from terminal 186. Furthermore, the lighter switch terminal 184 is electrically connected to the wire 126 from the positive terminal 130 of the battery 120, and the lighter switch terminal 186 is electrically connected to the wire 150 from the positive input 142 of the inverter 122.

Alternatively, the card lighter 100 can also include an additional pair of lighter contacts and an additional pair of lighter switch terminals located on face 168 of sheet 164 so as to allow the card 10 to be inserted with surface 20 facing either face 166 or face 168. Also, such an alternative embodiment could also accommodate an illuminatable card having power contacts and switch terminals on both card surfaces 18 and 20.

When the bottom 30 of the card 10 is inserted into the card chamber 116 through the slot 108 with the surface 20 facing sheet 162 and starts to slide between the sheets 162 and 164, the power contacts 14 and 16 will come into contact with the lighter contacts 172 and 174, respectively, and establish the first electrical connection between the inverter outputs 146 and 148 and the power contacts 14 and 16 of the card 10. As the bottom 30 of the card 10 is slid further down between the sheets 162 and 164, the pair of lighter switch terminals 184 and 186 will come into contact with the card switch terminal 28. The card switch terminal 28 electrically connects lighter switch terminal 184 to terminal 186 so that the second electrical connection is established between the positive terminal 130 of the battery 120 and the positive input 142 of the inverter 122. Once the second electrical connection has been established, the power supply circuit 118 becomes a closed circuit and can provide the AC voltage to the card 10 to illuminate the EL panel 12 and the image overlay 22. Because the card switch terminal 28 is positioned farther from the bottom edge 30 of the card 10 than the power contacts 14 and 16, the card switch terminal 28 will come into contact with the lighter switch terminals 184 and 186 after the power contacts 14 and 16 have come into contact with the lighter contacts 172 and 174. In other words, the second electrical connection will be established only after the first electrical connection has been established. Therefore, an AC voltage will not be developed across the inverter outputs 146 and 148 until the power contacts 14 and 16 are already in electrical communication with the inverter outputs 146 and 148, and arcing is reduced as a result.

Similarly, when the card 10 is removed from the lighter 100, because of the positioning of the card switch terminal 28, the second electrical connection will be broken before the first electrical connection is broken. Thus, when the power contacts 14 and 16 separate from the lighter contacts 172 and 174, respectively, there will be no AC voltage established across the lighter contacts 172 and 174 and arcing will be eliminated as a result.

FIGS. 8–13 show a second embodiment of a card lighter 200. The card lighter 200 is similar to card lighter 100 and can be fabricated using similar components and processes. Elements 200–256 of the lighter 200 correspond to elements 100–156 in the lighter 100 and are referenced with numerals that are incremented by 100 (e.g., the housing 102 of the lighter 100 corresponds to a housing 202 of the lighter 200). The card lighter 200 has a delay mechanism 258 that includes a contact holder 260. The contact holder 260 includes first and second elongated, planar sheets 262 and 264 made of an electrically insulating material such as plastic. The first sheet 262 is fixedly attached to (or formed integrally with) a support member 266 formed in the housing 202. A hinge 268 (perhaps shown best in FIG. 10) connects a bottom edge 272 of the second sheet 264 to a bottom surface of lower housing piece 206 so that the second sheet 264 can rotate about the hinge 268. A lever arm 274 is attached to a first lateral edge 297 of the second sheet 264 and has a distal portion 276 that passes through a second slot 278 (perhaps shown best in FIG. 12) formed in the upper housing piece 204. The lever arm 274 can be formed as a separate piece and attached to the second sheet 264 or formed integrally with the sheet 264. The second slot 278 is located to permit the lever arm 274 to project therethrough and has a generally elongated opening oriented perpendicularly to the first slot 208 that allows the distal portion 276 of the lever arm 274 to be used to rotate the second sheet 264 towards the first sheet 262. The slot 278 also can include a notch 280 that has a shape effective to lock the lever arm 274 into a position where the second sheet 262 is proximal to the second sheet 264.

Figure 8:
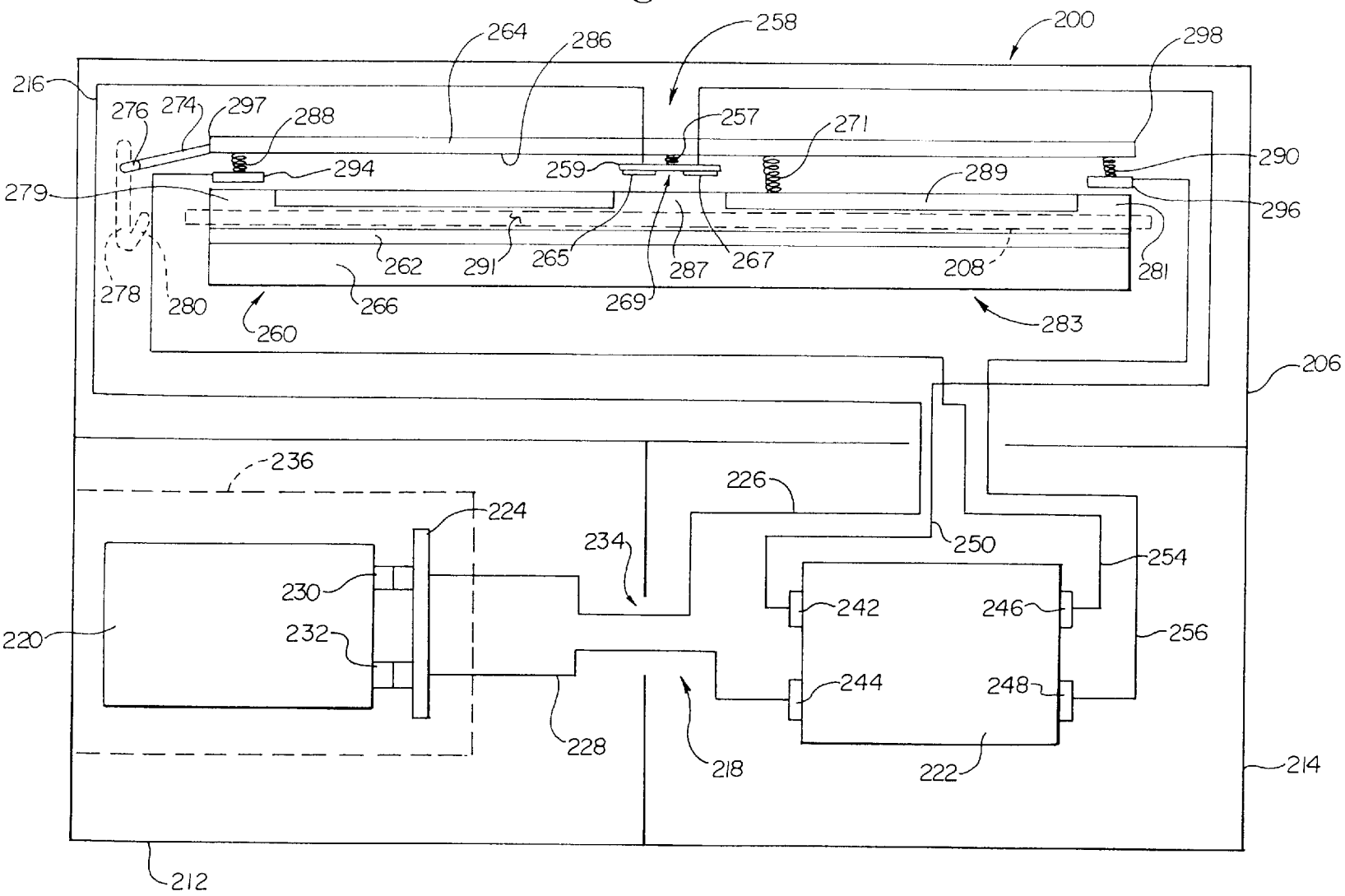
FIG. 8 is a layout diagram of a card lighter according to a second embodiment of the present invention.
Figure 9:
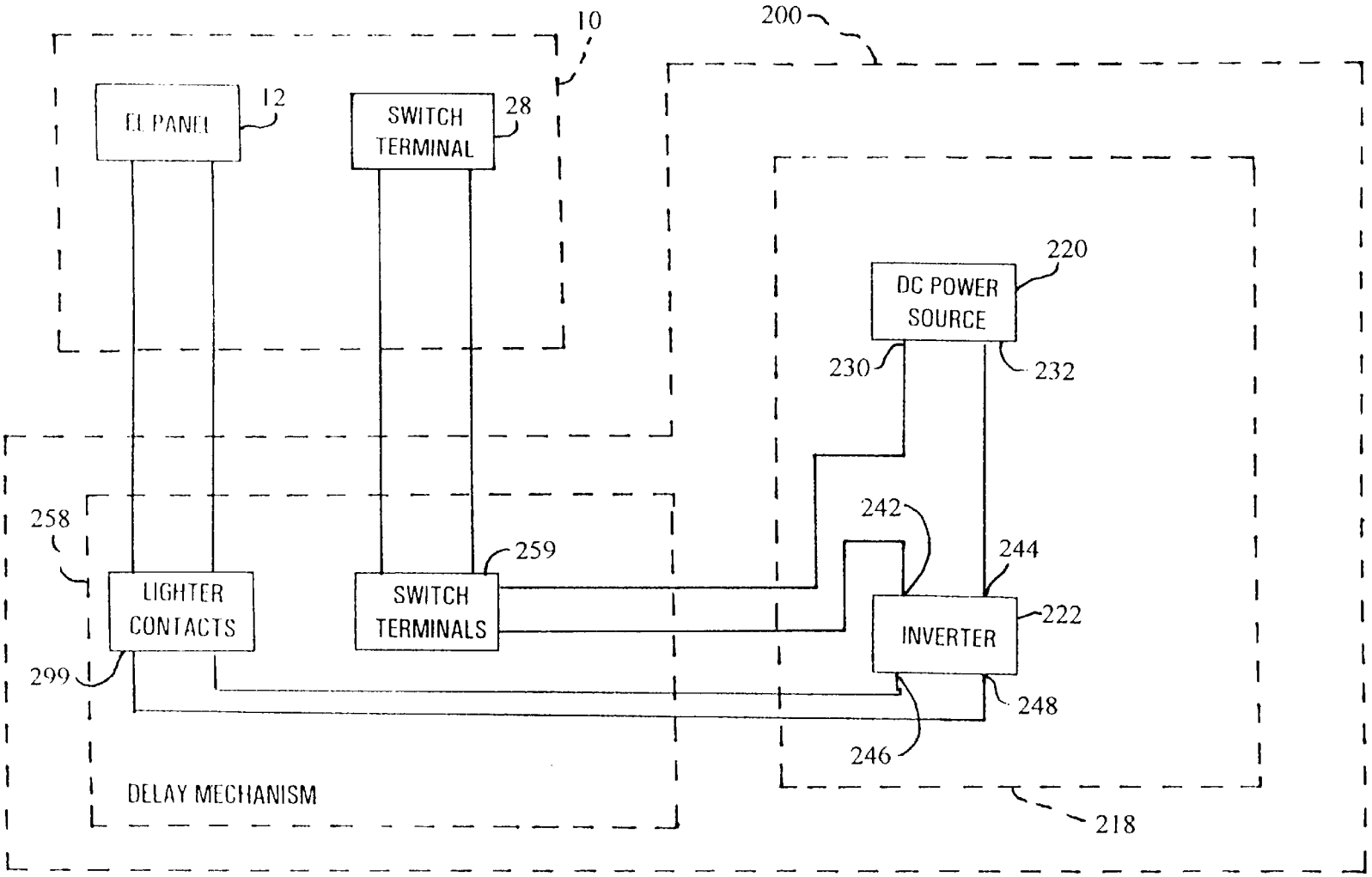
FIG. 9 is a block diagram of the card lighter shown in FIG. 8 connected to the card shown in FIGS. 1–4.
Figure 11:
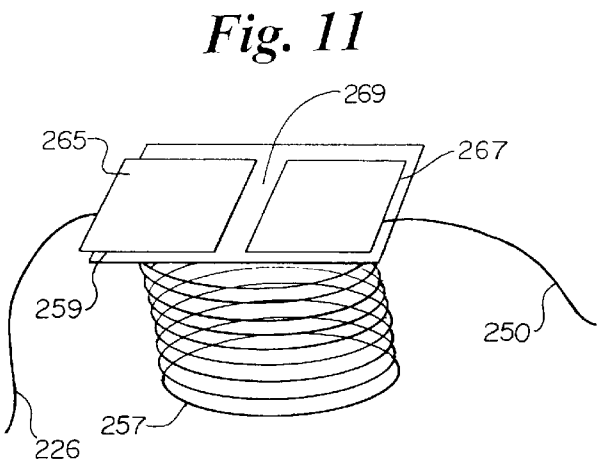
FIG. 11 is a detailed view of a switch terminal holder of the delay mechanism shown in FIG. 10 of the card lighter shown in FIGS. 8–9.
Figure 10:
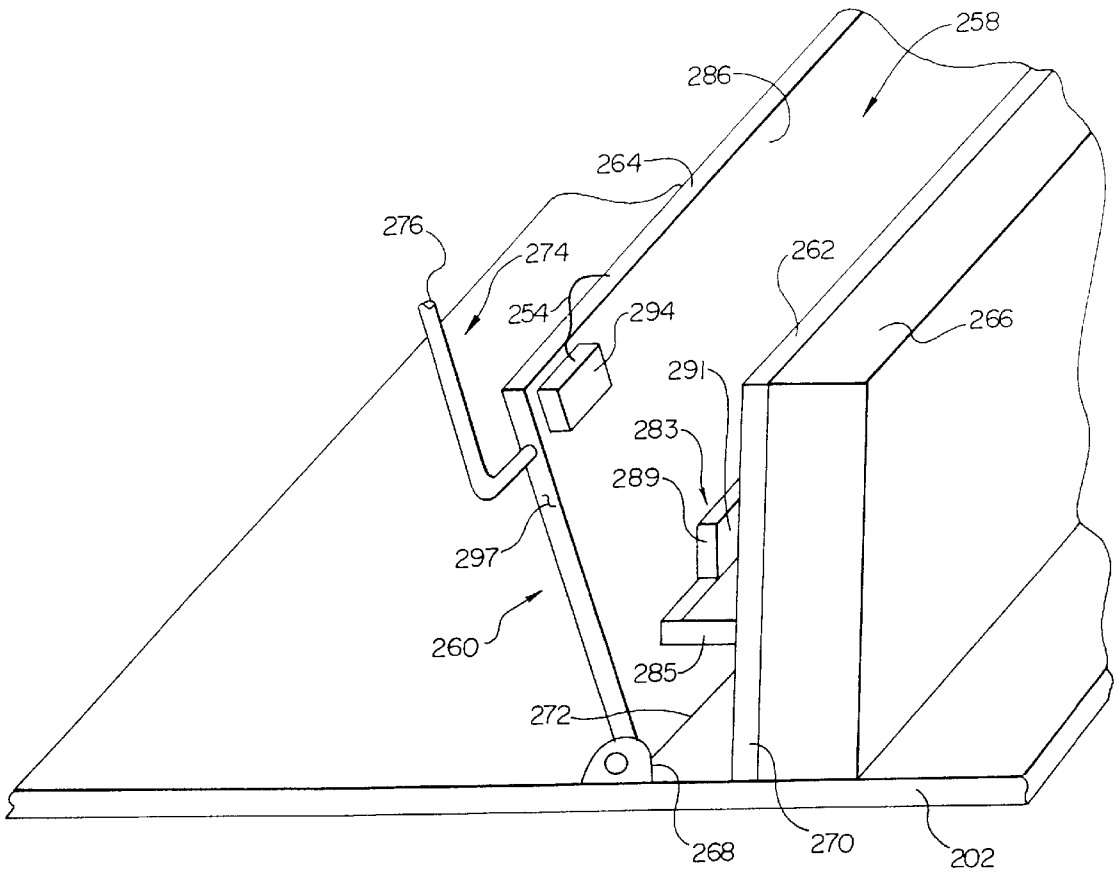
FIG. 10 is a perspective view of a delay mechanism of the card lighter shown in FIGS. 8–9.
Figure 12:
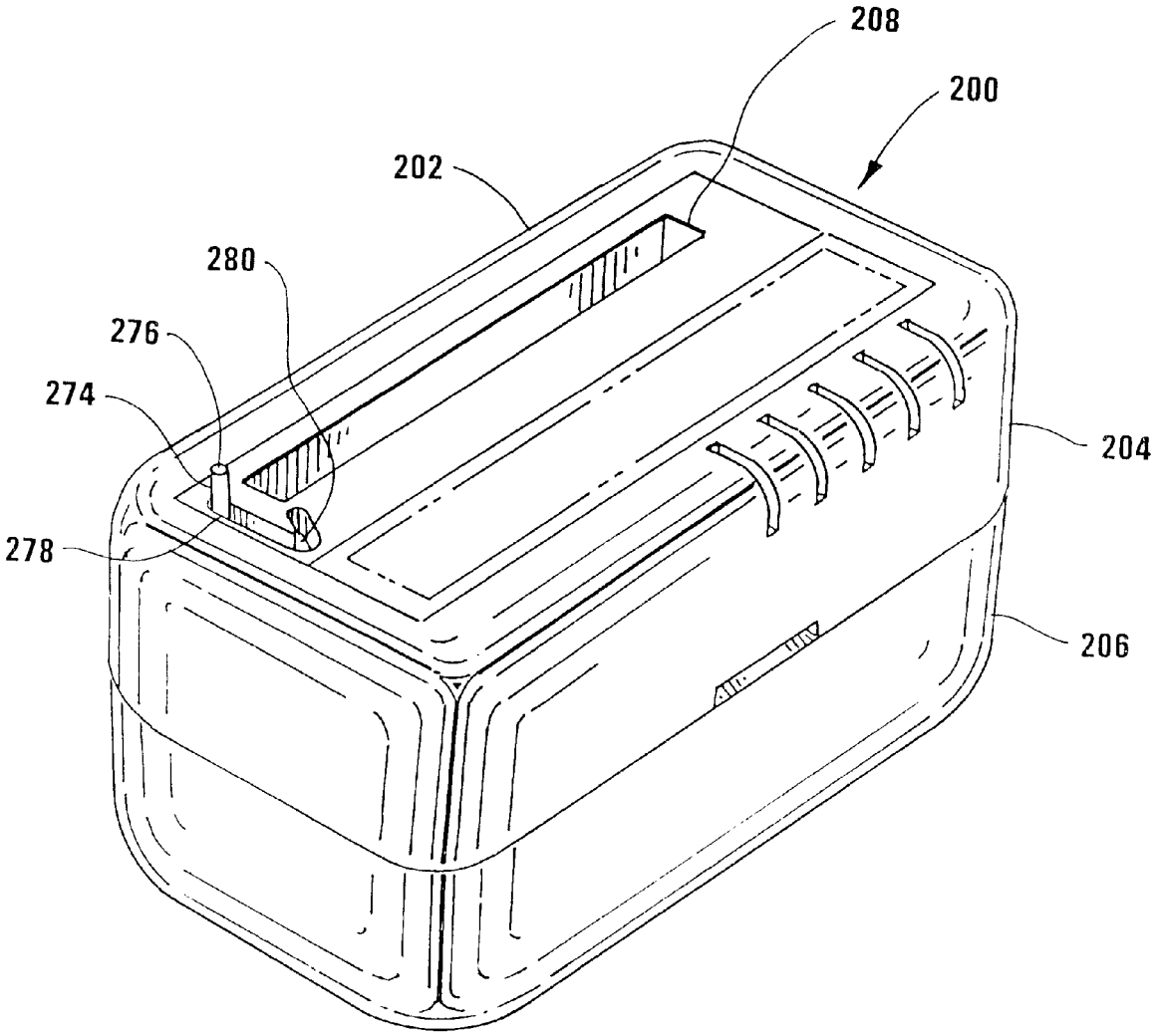
FIG. 12 is a perspective view of the card lighter shown in FIGS. 8–9.

As shown in FIGS. 8 and 10, a card focuser or support 283 is attached to a surface of the first sheet 262 facing the second sheet 264. The card focuser 283 is located beneath the slot 208 and has a rectangular shape that can receive the portion of the card 10 that is inserted through the slot 208. The card focuser 283 includes a cantilever base support member 285 attached to and extending from the surface of the sheet 262. The bottom edge 30 of the card 10 rests upon the base support member 285 when the card 10 is inserted into the lighter 200. The card 10 is held in place on the base support member 285 by a restraining wall 289 that is formed on a distal end of support member 285. The base support member 285 and the restraining wall 289 form an elongated groove 291 having a length and width slightly larger than the cross sectional length and width of the card 10 so that the card 10 may be inserted into the groove 291 and held in place by the base support member 285 and the restraining wall 289.

Lighter contact springs 288 and 290 each have one end attached to a surface 286 of the second sheet 264 that faces the first sheet 262. A pair 299 of lighter contacts 294 and 296 are generally rectangular, conductive strips (preferably formed from copper) that are attached to the other end of springs 288 and 290. Lighter contact 294 is attached to the other end of spring 288, and lighter contact 296 is attached to the other end of spring 290. The lighter contact springs 288 and 290 and lighter contacts 294 and 296 are arranged on the surface 286 in positions that allow the lighter contacts 294 and 296 to touch the power contacts 14 and 16, respectively, when the bottom 30 of the card 10 is inserted through slot 208 into the housing 202 and the second sheet 264 is rotated proximal to the first sheet 262. To accommodate the arrangement of the power contacts 14 and 16 on the card 10, the lighter contact spring 288 and the lighter contact 294 are positioned immediately adjacent to the first lateral edge 297 of the sheet 264 and far enough up from the lower edge 272 of the sheet 264 so that the lighter contact 294 will be aligned with the power contact 14 when the second sheet 264 is rotated proximal to the card 10 (inserted with surface 20 facing surface 286). Similarly, the lighter contact spring 290 and the lighter contact 296 are positioned immediately adjacent to a second lateral edge 298 of the sheet 264 and far enough up from the lower edge 272 so that the lighter contact 296 will be aligned with the power contact 16 when the second sheet 264 is rotated proximal to the card 10. The AC wire 254 electrically connects inverter output 246 to the lighter contact 294, and the AC wire 256 electrically connects inverter output 248 to the lighter contact 296. Gaps 279 and 281 are formed at opposite ends of the restraining wall 289. The gaps 279 and 281 in the restraining wall 289 are wide enough to allow the lighter contacts 294 and 296, respectively, to access the power contacts 14 and 16, respectively, so that the first electrical connection between the inverter outputs 246 and 248 and the power contacts 14 and 16 can be established by inserting the electrode portion of the card 10 into the slot 208 and having the power contacts 14 and 16 touch the lighter contacts 294 and 296, respectively, when the second sheet 264 is rotated proximal to the first sheet 262 via the lever arm 274.

A lighter switch terminal spring 257 is attached at one end to the surface 286 and at the other end to a switch terminal holder 259. Switch terminal holder 259 (shown in detail in FIG. 11) includes a rectangular, electrically insulating sheet (having a shape and size similar to that of the card switch terminal 28) on which first and second switch terminals 265 and 267 are attached. The first and second lighter switch terminals 265 and 267 are generally rectangular conductive strips (preferably formed from copper) that are located on the switch terminal holder 259 on a surface of the terminal holder 259 opposite the spring 257. The first and second lighter switch terminals 265 and 267 are separated and electrically isolated from one another by a space 269. The first lighter switch terminal 265 is electrically connected to the positive terminal 230 of the battery 220 through the wire 226, and the second lighter switch terminal 267 is electrically connected to the positive input 242 of the inverter 222 through the wire 250.

The lighter switch terminal spring 257 and lighter switch terminals 265 and 267 are arranged on the surface 286 in a position that allows the lighter switch terminals 265 and 267 to touch the card switch terminal 28 when the bottom 30 of the card 10 is inserted through slot 208 into the housing 202 and the second sheet 264 is rotated proximal to the card 10. To accommodate the location of the card switch terminal 28 shown in FIGS. 1–4, the lighter switch terminal spring 257 and the lighter switch terminals 265 and 267 are centered between the lateral sides 297 and 298 and are positioned far enough up from the lower edge 272 of the sheet 264 so that the lighter switch terminals 265 and 267 will be aligned with the card switch terminal 28 when the second sheet 264 is rotated proximal to the card 10. A gap 287 is formed in the restraining wall 289 at a position that is centered between the two lateral ends of the restraining wall 289. The gap 287 in the restraining wall 289 is wide enough to allow both the lighter switch terminals 265 and 267 to access the card switch terminal 28 when the second sheet 264 is rotated proximal to the first sheet 262.

Figure 13:
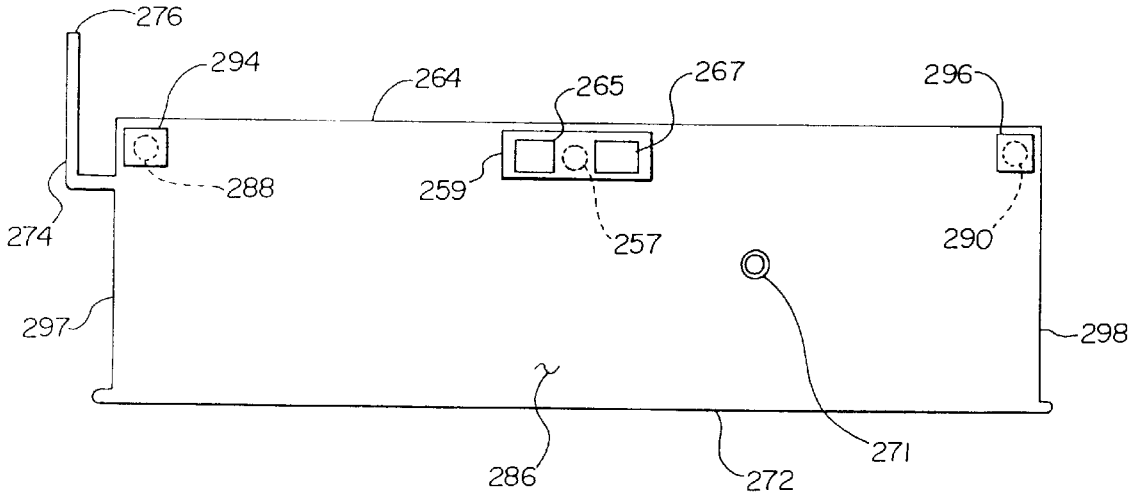
FIG. 13 is a detailed front view of a second sheet of the card lighter shown in FIGS. 8–9.
Figure 14:
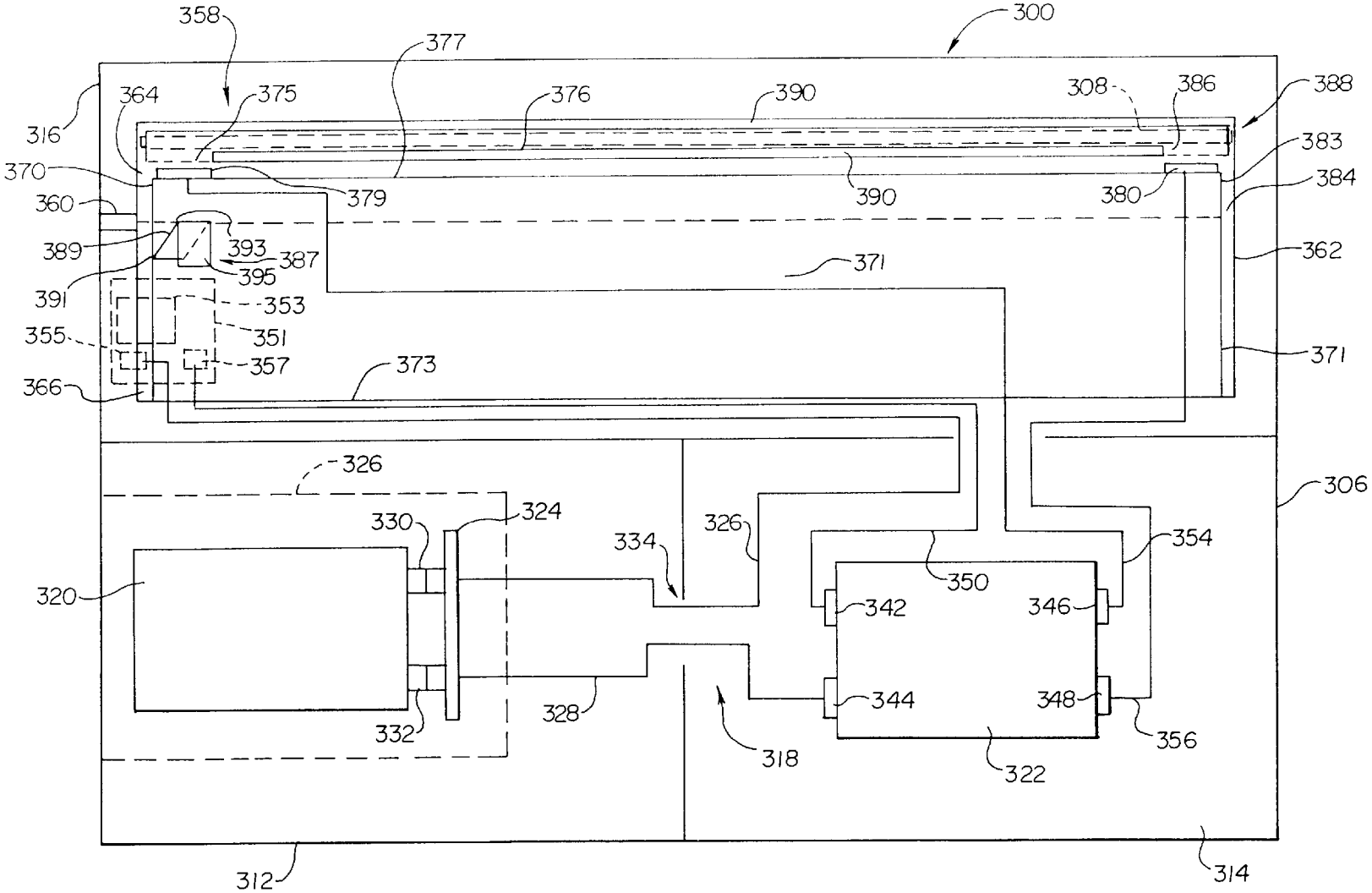
FIG. 14 is a layout diagram of a card lighter according to a third embodiment of the present invention.
Figure 15:
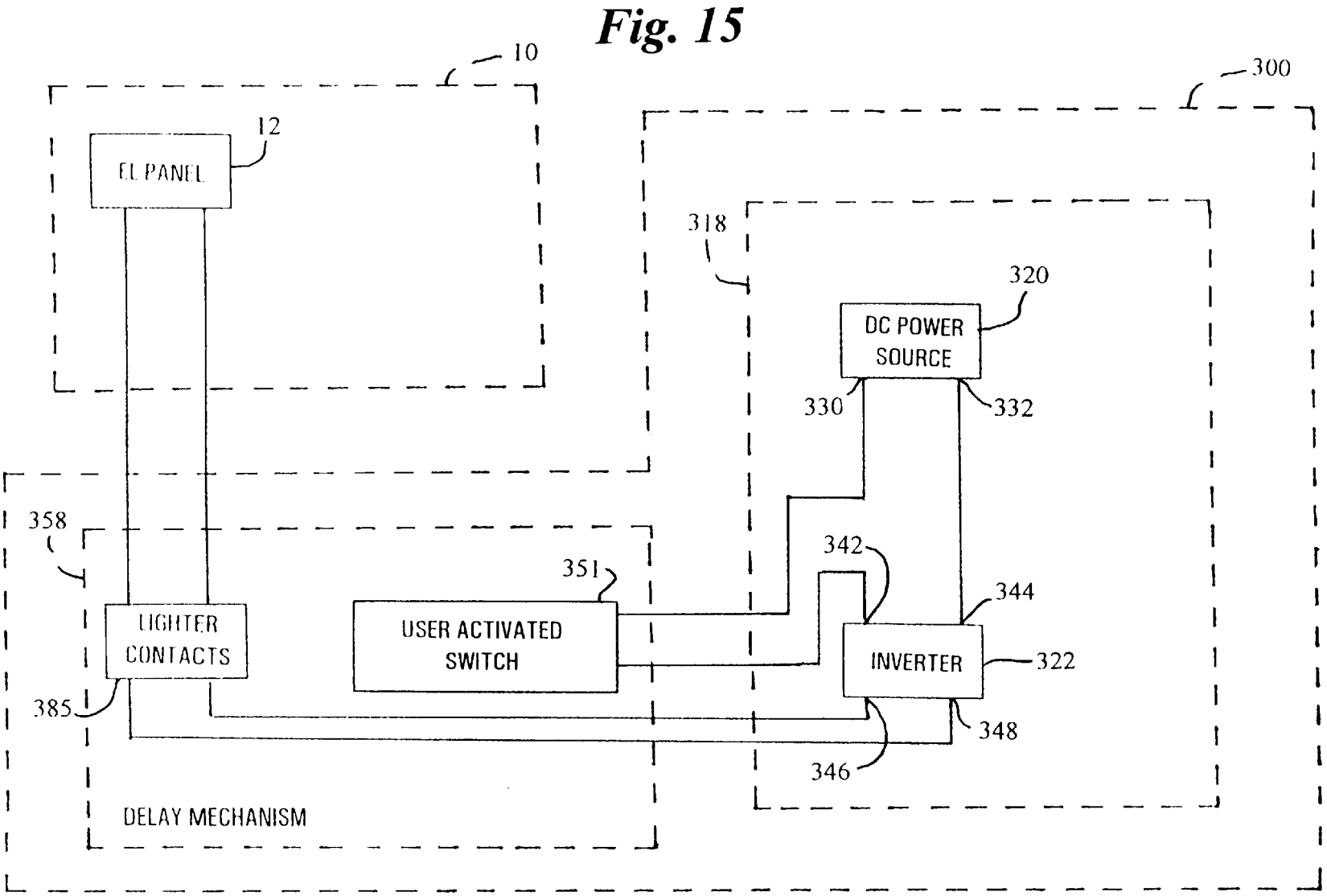
FIG. 15 is a block diagram of the card lighter shown in FIG. 15 connected to an internally illuminatable card according to the present invention.
Figure 16:
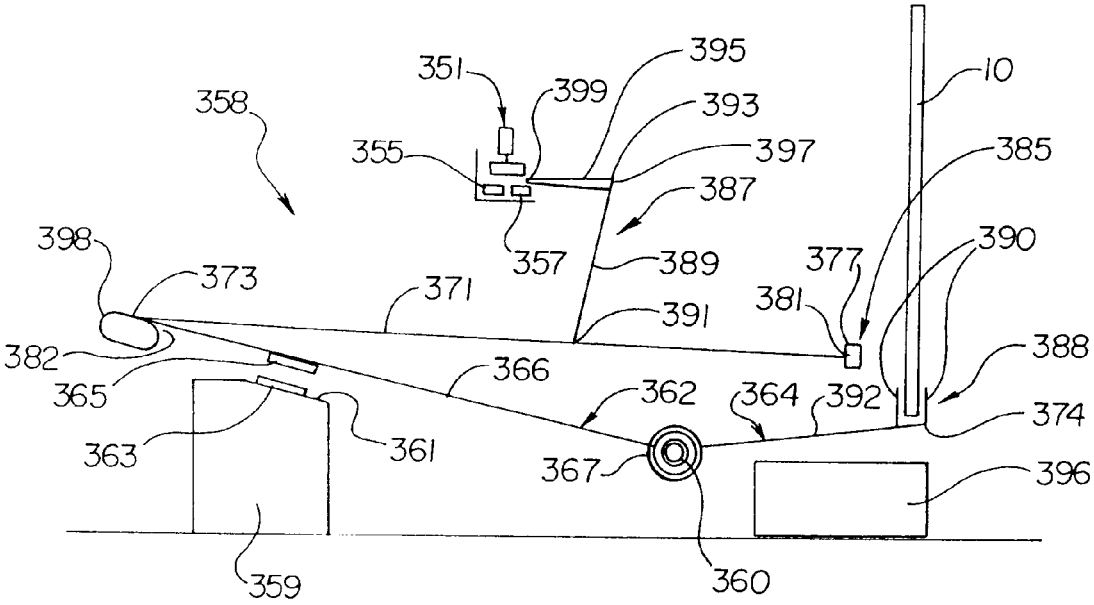
FIG. 16 is a simplified side view of the delay mechanism of the card lighter shown in FIGS. 14–15.
Figure 17:
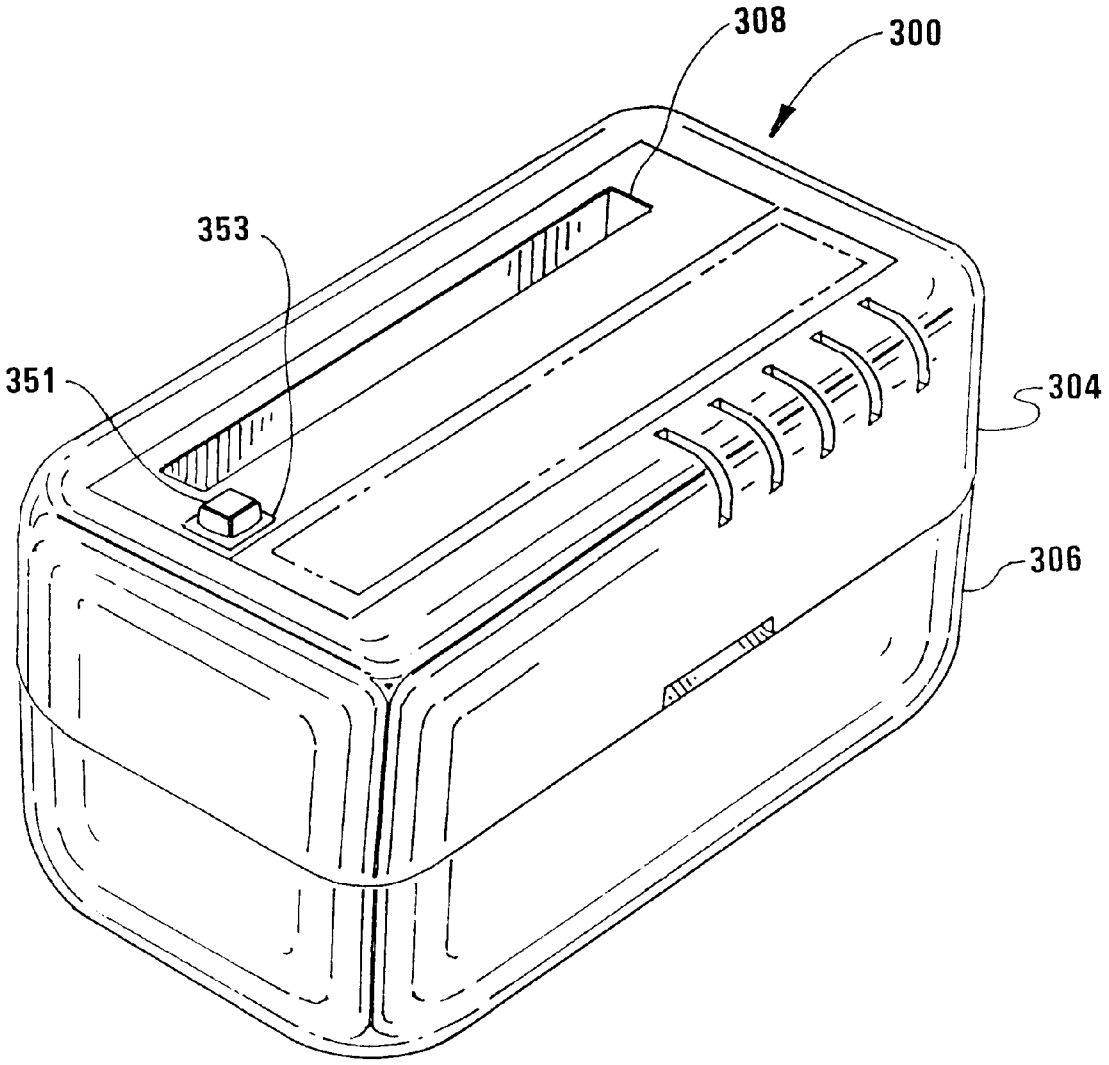
FIG. 17 is a perspective view of the card lighter shown in FIGS. 14–15.
Figure 18:
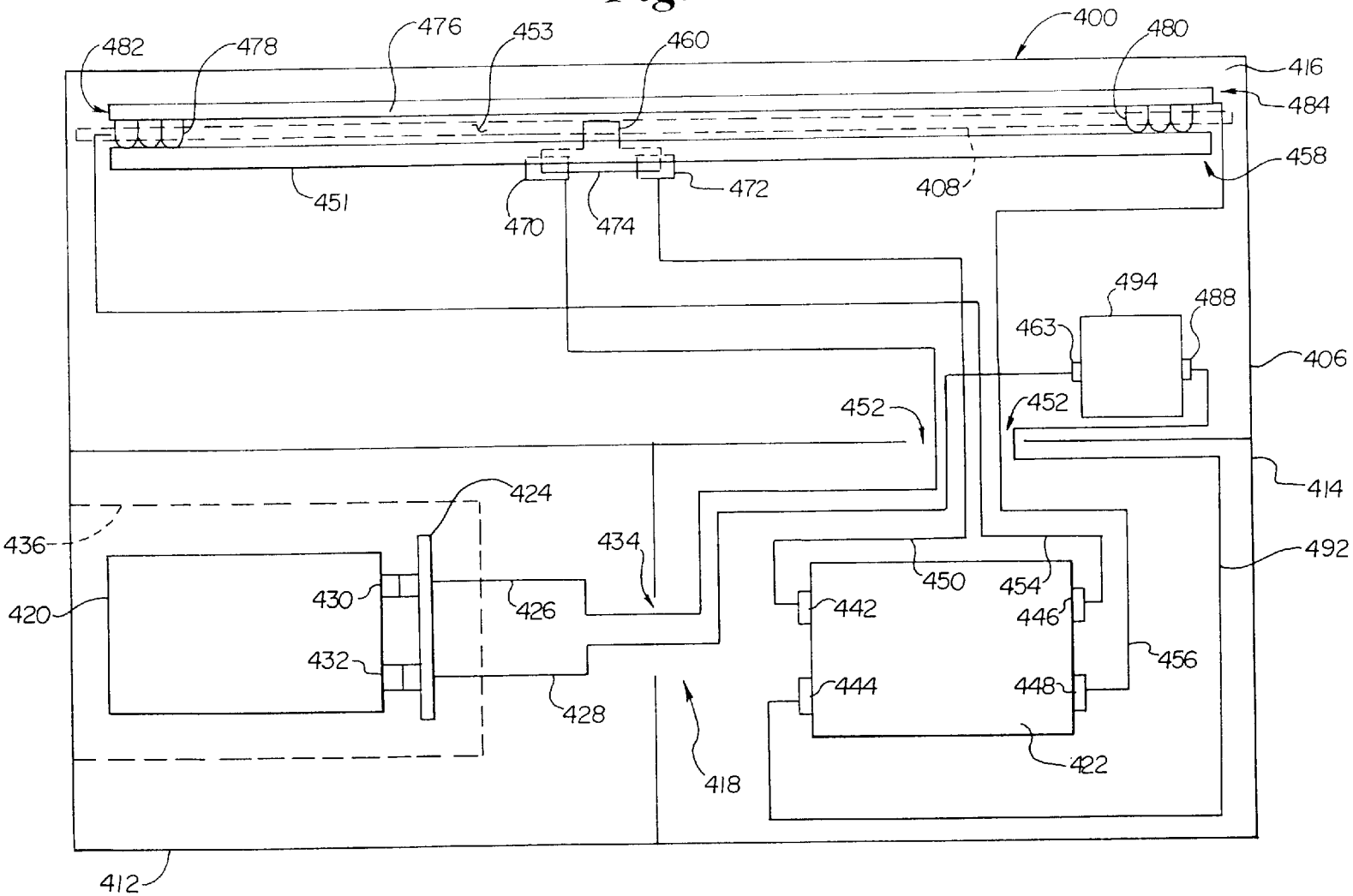
FIG. 18 is a layout diagram of a card lighter according to a fourth embodiment of the present invention.
Figure 19:
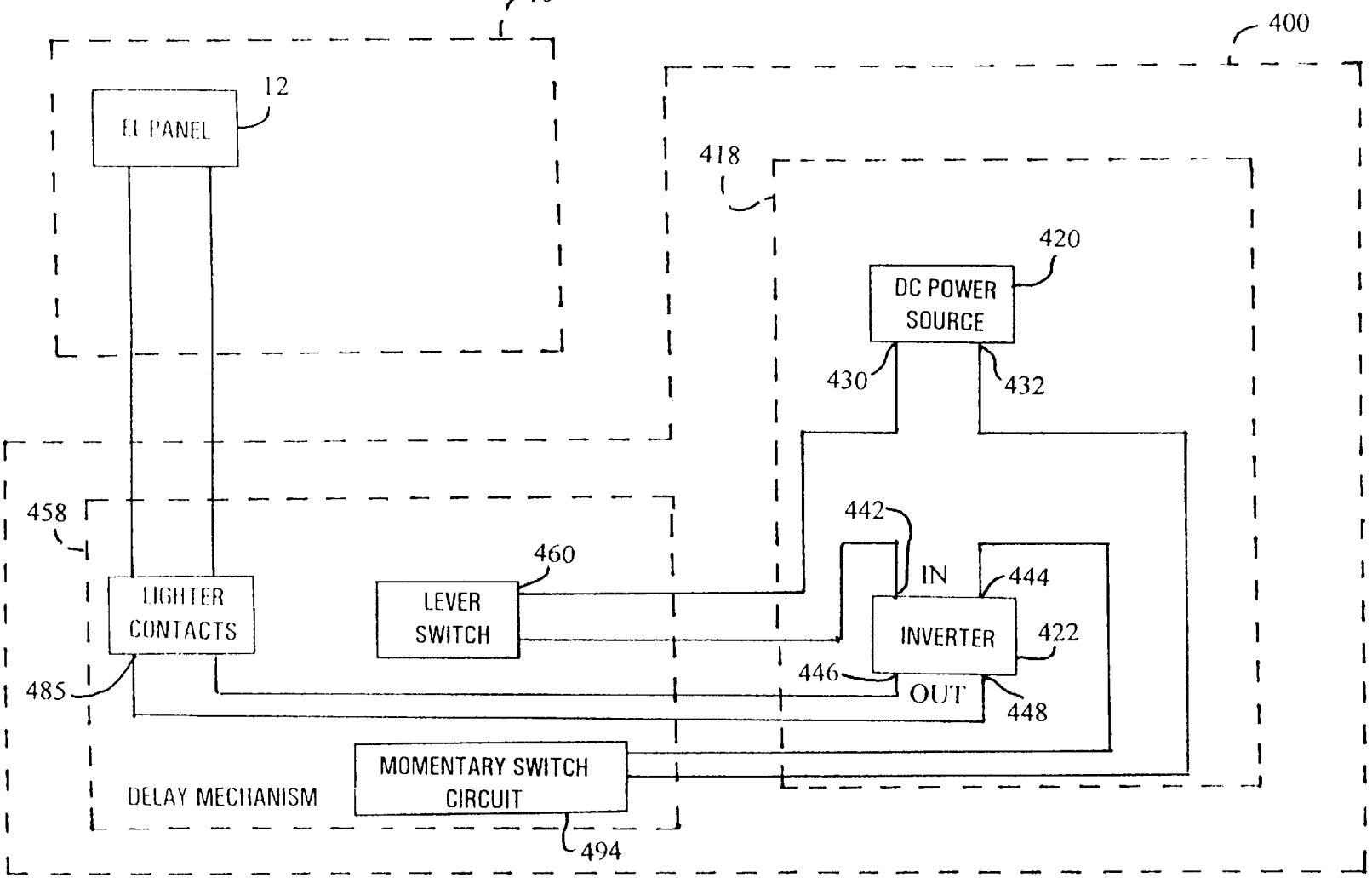
FIG. 19 is a block diagram of the card lighter shown in FIG. 18 connected to an internally illuminatable card according to the present invention.
Figure 20:
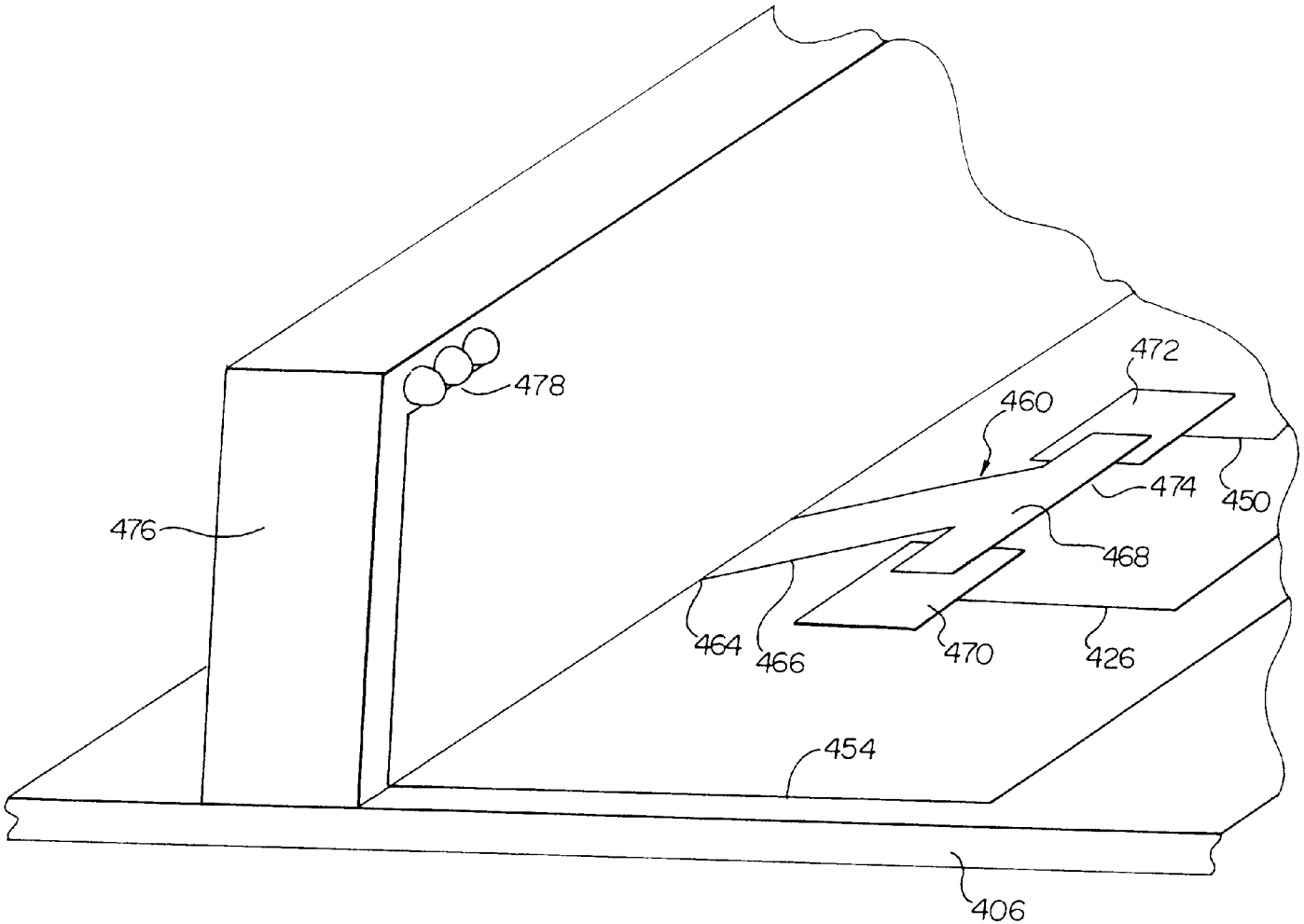
FIG. 20 is a simplified fragmentary perspective view of a lever switch of the card lighter shown in FIGS. 18–19 with the second support member removed.
Figure 21:
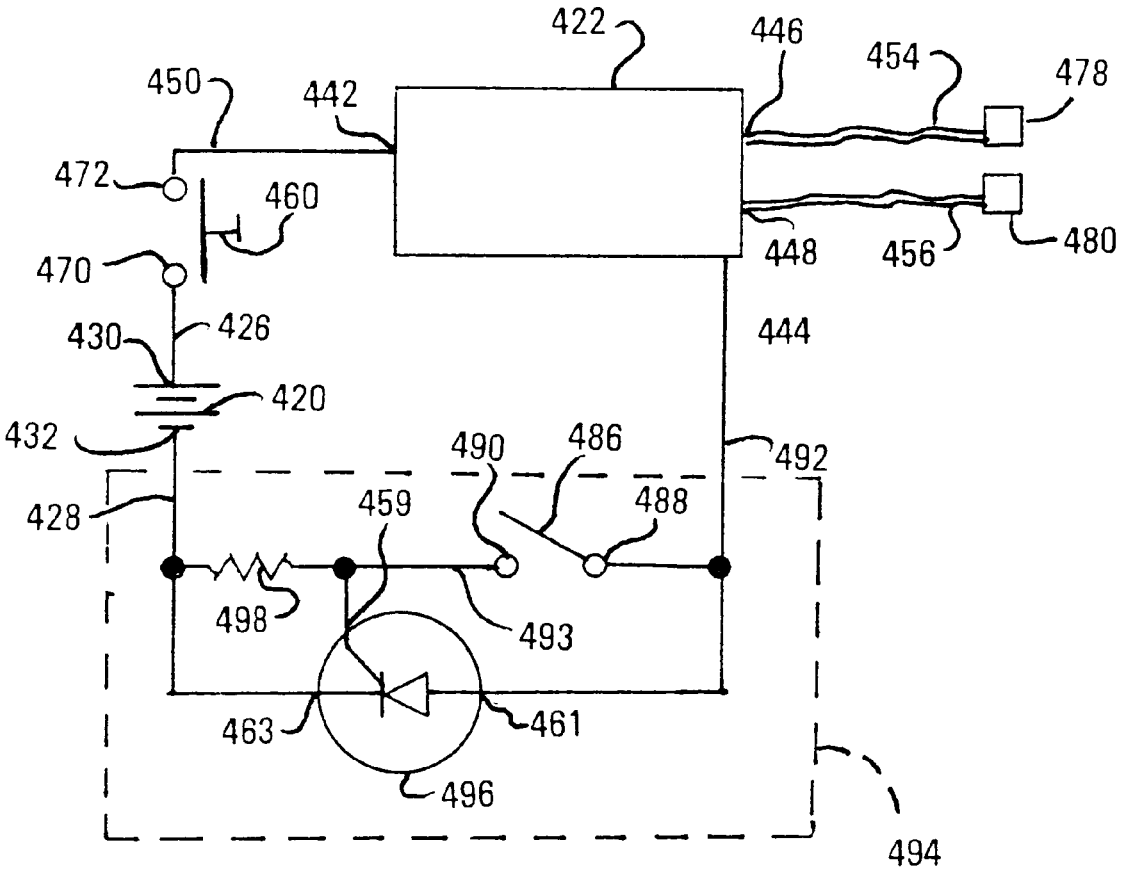
FIG. 21 is a circuit diagram of a momentary switch circuit connected to a power supply circuit and inverter of the card lighter shown in FIGS. 18–19.

As shown in FIG. 13, a separation spring 271 is located on the surface 286 of the sheet 264 closer to the lower edge 272 than the lighter contact springs 288 and 290 and the lighter switch terminal spring 257. As shown in FIG. 8, the separation spring 271 has a length that is longer than the lighter contact springs 288 and 290, which have lengths that are both longer than the lighter switch terminal spring 257.

The card lighter 200 is used to illuminate the card 10 by inserting the card 10 into the lighter 200 through the slot 208 with surface 20 of the card 10 facing surface 286. The bottom edge 30 of the card 10 is received by the card focuser 283 in the groove 291, and the lever portion 276 is moved towards the notch 280 to rotate the second sheet 264 towards the portion of the card 10 in the card focuser 283. The separation spring 271, because of its length and location on the second sheet 264, comes into contact with the first sheet 262 before the other springs come into contact with the card 10. The separation spring 271 resists the rotation of the second sheet 264 towards the first sheet 262 which helps prevent the card 10 from being inadvertently turned on. However, the resistive force exerted by the separation spring 271 is not so great as to prevent the second sheet 264 from being intentionally rotated towards the first sheet 262. As the second sheet 264 is rotated closer to the first sheet 262, the lighter contacts 294 and 296 attached to the ends of the lighter contact springs 288 and 290, respectively, will come into contact with the power contacts 14 and 16, respectively, and establish the first electrical connection between the outputs 246 and 248 of the inverter 222 (through the AC wires 256 and 254) and the power contacts 14 and 16. As the second sheet 264 is rotated even closer to the first sheet 262, the lighter switch terminals 265 and 267 attached to the lighter switch spring 257 will touch the card switch terminal 28, which electrically connects the lighter switch terminals 265 and 267 to each other and establishes the second electrical connection between the positive terminal 230 of the battery 220 and the positive input 242 of the inverter 222. Once the second electrical connection has been established, the power supply circuit 218 is a closed circuit and AC electrical energy from the inverter 222 is coupled to the card 10 to illuminate the EL panel 12 and the image overlay 22. The first electrical connection is established before the second electrical connection (thereby reducing the occurrence of arcing) because the lighter contact springs 288 and 290 are longer than the lighter switch springs 257. The lever arm 274 can be moved into the notch 280 to lock the lever arm 274 (and the second sheet 264) in a position effective to maintain the first and second electrical connections. The lighter contact springs 288 and 290 press the lighter contacts 294 and 296 against the power contacts 14 and 16, respectively, and the lighter switch spring 257 presses and the lighter switch terminals 265 and 267 against the card switch terminal 28 to continuously maintain the electrical connections while the lever arm 274 is locked into the notch 280.

The card 10 is removed from the lighter 200 by moving the lever arm 274 out of the notch 280 and moving the lever arm 274 away from the notch 280. Moving the lever arm 274 away from the notch 280 rotates the second sheet 264 away from the first sheet 262. Because the lighter switch spring 257 is shorter than the lighter contact springs 288 and 290, the second electrical connection will be broken before the first electrical connection is broken as the second sheet 264 is rotated away from the first sheet 262. Arcing is reduced because breaking the second electrical connection first prevents an AC voltage from being developed across the outputs 246 and 248 of the inverter 222 when the first electrical connection is broken.

FIGS. 14–17 show a third embodiment of a card lighter 300 that can illuminate a card 10 shown in FIGS. 1–4 or an illuminatable card having an alternative design that includes, e.g., only power contacts and no switch terminal on the card. The card lighter 300 is similar to the card lighter 100 and can be fabricated using similar processes. Elements 300–356 of the lighter 300 correspond to elements 100–156 in the lighter 100 and are referenced with numerals that are incremented by 200 (e.g., the housing 102 of the lighter 100 corresponds to a housing 302 of the lighter 300). The card lighter 300 has a delay mechanism 358 that includes an axle 360 extending across the card chamber 316 and having two ends mounted in the housing 302 such that the axle 360 can rotate about its longitudinal axis.

The delay mechanism 358 further includes a bascule 362 having first and second planar portions 364 and 366. The first planar portion 364 is joined to the second planar portion 366 at a bascule sleeve 367 so that the first planar portion 364 and the second planar portion 366 form an obtuse angle. The axle 360 runs through the interior of the sleeve 367 so that the bascule 362 can rotate about the axle 360. A card holder 388 is attached to an end 374 of the first planar portion 364 and is located directly underneath the slot 308. The card holder 388 includes a rectangular ridge 390 formed on an upper surface 392 of the first planar portion 364. The rectangular ridge 390 defines a groove 394 having a length and width sufficient to receive and support the portion of the card 10 inserted through the slot 308 into the card chamber 316. Gaps 375 and 386 are formed in a lengthwise portion 376 of the restraining ridge 390 at opposite lateral ends of the card holder 388. The gaps 375 and 386 have shapes effective to allow access through the restraining ridge 390 to the power contacts 14 and 16. The delay mechanism 358 further includes a first platform 396 that is located generally beneath the slot 308 and is either formed integrally with the housing 302 or formed from a separate piece that is attached to the housing 302.

A counterweight 398 is attached to an end 382 of the second planar portion 366. The counterweight 398 has a mass sufficient to cause the end 382 to rotate down when the card 10 is removed from the card holder 388. A second platform 359 is located generally underneath the second planar portion 366 and has an angled upper surface 361 on which a first magnet 363 is attached. A second magnet 365 is attached to the lower surface of the second planar portion 366. The first and second magnets 363 and 365 are arranged such that a face of the first magnet 363 opposes and has a magnetic pole opposite that of a face of the second magnet 365 so that there is an attractive magnetic force between magnets 363 and 365.

A cantilever beam 371 is attached at a proximal end 373 to the end 382 of the second planar portion 366 so that the cantilever beam 371 and the second planar portion 366 form an acute angle. At a distal end 377 of the beam 371, a pair 385 of lighter contacts 379 and 381 are mounted. Lighter contacts 379 and 381 are generally rectangular, conductive islands (preferably formed from copper). Lighter contact 379 is located adjacent to a lateral edge 370 of the distal end 377 of the beam 371, and lighter contact 381 is located adjacent to the other lateral edge 383 of the distal end 377 of the beam 371 so that the lighter contacts 379 and 381 are aligned with the gaps 375 and 386, respectively. An AC wire 354 electrically connects the lighter contact 379 to the output 346 of the inverter 322, and an AC wire 356 electrically connects the lighter contact 381 to the output 348 of the inverter 322.

An L-shaped restricting arm 387 includes a first member 389 attached at a first end 391 to the upper surface of the beam 371 in between the distal and proximal ends 377 and 373. A first end 393 of a second member 395 is joined at an angle with a second end 397 of the first member 389. A second end 399 of the second member 395 extends into a user-activated switch 351. The user-activated switch 351 is attached to the upper housing piece 304 and is accessible through a hole 353 formed in the upper housing piece 304. The switch 351 has two switch terminals 355 and 357 to which the wire 326 from the positive terminal 330 of the battery 320 and the wire 350 from the positive input 342 of the inverter 322, respectively, are electrically connected. The switch 351 can be a conventional push button switch modified to allow the second end 399 of the second member 395 to prevent the switch 351 from being moved into an "ON" position that would establish an electrical connection between the two switch terminals 355 and 357. When the switch 357 is in the ON position, an electrical connection is established between the positive terminal 330 of the battery 320 and the positive input 342 of the inverter 322. Preferably, the switch 351 has a design element such as a detent that allows the switch 351 to be selectively locked or otherwise held in the ON position.

When there is no card 10 in the card lighter 300, the lower surface of the second planar portion 366 will be proximal to the upper surface 361 of the second platform 359 and the two magnets 363 and 365 will touch one another and exert an attractive force that maintains the bascule 362 in such a position. When the bottom edge 30 of the card 10 is inserted through the slot 308 with the surface 20 facing distal end 377, the bottom edge 30 of the card 10 will be received by the card holder 388. The insertion force transmitted by the card 10 causes the first planar portion 364 of the bascule 362 to rotate down towards the first platform 396. The downward rotation of the first planar portion 364 causes the second planar portion 366 of the bascule 362 to rotate upward separating the magnets 363 and 365 and causing the distal end 377 of the beam 371 to rotate towards the card 10. The delay mechanism 358 is adapted so that the lighter contacts 379 and 381 will pass through the gaps 375 and 386 and come into contact with the power contacts 14 and 16, respectively. The contact between the lighter contacts 379 and 381 and the power contacts 14 and 16 establishes the first electrical connection. As the bascule 362 further rotates, the beam 371 rotates toward the card 10 causing the second member 395 of the restricting arm 387 to rotate towards the card 10. The restricting arm 387 and the switch 351 are configured so that when the second member 395 rotates away from the switch 351, the switch 351 is no longer prevented from being moved into the ON position. Therefore, when the user ultimately moves the switch 351 into the ON position, the switch terminals 355 and 357 are electrically connected and the second electrical connection is established between the positive terminal 330 of the battery 320 and the positive input 342 of the inverter 322. Establishment of the second electrical connection creates a closed circuit in the power supply circuit 318 and couples AC electrical energy to the card 10 so as to illuminate the EL panel 12 and the image overlay 322. Arcing is reduced because the second electrical connection is prevented from occurring by the restricting arm 387 until after the first electrical connection has been established.

When the card 10 is removed from the lighter 300 while the switch 351 is still in the ON position, arcing is still reduced. As the card 10 is removed from the lighter 300, the downward force urged on the second planar portion 366 of the bascule 362 by the counterweight 398 and the magnets 363 and 365 will no longer be counterbalanced by the weight of the card 10. As a result, the second planar portion 366 of the bascule 362 rotates downward toward the second platform 359, and the first planar portion 364 rotates upward causing the beam 371 to rotate back from the card 10. As the bascule 362 rotates, the second electrical connection is broken by the second member 395 of the restricting arm 387 moving into the switch 351 and preventing the switch 351 from remaining in the ON position. It is to be understood that second member 395 will exert sufficient force to overcome the detent of switch 351. The second electrical connection is broken while the first electrical connection is still maintained. As the bascule 362 further rotates, the distal end 377 of the beam 371 moves away from the card 10 and the first electrical connection is broken as the lighter contacts 379 and 381 move away from the power contacts 14 and 16, respectively. Therefore, arcing is reduced because no AC voltage will be developed across the outputs 346 and 348 of the inverter 322 (because the second electrical connection is broken) when the power contacts 14 and 16 are separated from the lighter contacts 379 and 381.

FIGS. 18–21 show a fourth embodiment of a card lighter 400 that can illuminate card 10 shown in FIGS. 1–4 or an illuminatable card having an alternative design that includes power contacts and no switch terminal. The card lighter 400 is similar to the card lighter 100 and can be fabricated using similar processes. Elements 400–426, 430–448, 450, 452, 454, and 456 of the lighter 400 correspond to elements 100–126, 130–148, 150, 152, 154, and 156 in the lighter 100 and are referenced with numerals that are incremented by 300 (e.g., the housing 102 of the lighter 100 corresponds to a housing 402 of the lighter 400).

The card lighter 400 has a delay mechanism 458 having a lever switch 460 (perhaps shown best in FIG. 20 with some components of card lighter 400 removed) that is positioned beneath the slot 408. The lever switch 460 includes a leaf spring formed from a conductive metal such as beryllium copper or other suitable material and has a mounting region 464 at a proximal end of the lever switch 462 that is secured to the bottom of the lower housing piece 406, a spring region 466 extending from the mounting region 464, and a contact region 468 at a free, distal end of the lever switch 460 that extends from the spring region 466. The contact region 468 is wider than the spring region 464 so that the lever switch 460 has a T-shape. Directly beneath the contact region 468 of the lever switch 460 are first and second electrodes 470 and 472 formed from a conductive material such as copper on the upper surface of the lower housing piece 406. A wire 426 electrically connects the positive terminal 430 of the battery 420 to the first electrode 470, and another wire 450 electrically connects the positive input 442 of the inverter 422 to the second electrode 472. The first and second electrodes 470 and 472 are separated and electrically isolated from each other by a space 474 formed in the upper surface of the lower housing piece 406.

A support member 476 extends from the upper surface of the lower housing piece 406 generally beneath the slot 408 with the member 476 substantially parallel with the slot 408. A second support member 451 (shown in FIG. 18) extends from the upper surface of the lower housing piece 406 also generally beneath the slot 408 and is parallel to the support member 476 with a space 453 between the two support members 476 and 451. The support members 476 and 451 are at least as wide as the card 10, and a passageway or gap (not shown) is formed in support member 451 so as to allow switch 460 to move up and down. A pair 485 of lighter contacts 478 and 480 is located on a surface of the support member 476. Preferably, each lighter contact 478 and 480 is formed as three hemispherical brass contacts that are closely spaced and have low surface area with the first lighter contact 478 located adjacent to a first lateral side 482 of the support member 476, and the second lighter contact 480 adjacent to a second lateral side 484. The contacts 478 and 480 are conductive, flexible hemispheres formed from a conductive material, preferably brass, and are resilently secured to the support member 476 in a way so that applying pressure against the contacts 478 and 480 will cause the contacts 478 and 480 to resilently retract in a direction away from the opposing support member 451. A wire 454 electrically connects lighter contact 478 to the AC output 446 of the inverter 422, and a wire 456 electrically connects the lighter contact 480 to the AC output 448 of the inverter 422.

The delay mechanism 458 further includes a momentary switch circuit 494 (shown in detail in FIG. 21) having a momentary switch 486 that is attached to and is accessible through the upper housing piece 404. The momentary switch 486 has two terminals 488 and 490 and is designed to electrically connect the two terminals 488 and 490 when a user closes the switch 486 by positioning the switch 486 in the ON position. The momentary switch 486 is designed so that when the user ceases to maintain the switch 486 in the ON (closed) position, the electrical connection between the two terminals 488 and 490 is no longer maintained. A suitable momentary switch 486 is Part No. D2F-L from OMRON Corp. of Schaunberg, Ill. The first terminal 488 of switch 486 is electrically connected to the negative input 444 of the inverter 422 by a wire 492. The momentary switch circuit also includes a conventional silicon controlled rectifier ("SCR") 496, and a conventional resistor 498. A wire 493 connects the second terminal 490 of switch 486 to a gate 459 of the SCR 496. The SCR 496 also has an anode 461 that is electrically connected to the negative input 444 of the inverter 422 by the wire 492 and a cathode 463 that is electrically connected to the negative terminal 432 of the battery 420 by the wire 428. The resistor 498 is electrically connected at one end to the gate 459 and at the other end to the negative terminal 432 of the battery 420 via the wire 428. A suitable SCR 496, commercially available from NTE Electronics, Inc. of Bloomfield, N.J. is the NTE 5400 sensitive gate rated at 30 V at 0.8 Amps. A suitable resistor 498 has a resistance of 1.3 megohms, a power of 0.25 watt, and is widely available from suppliers such as YAGEO, of Hsin Tien, Taipei, Taiwan.

When the card 10 is inserted into the housing 402 through slot 408 with surface 20 facing support member 476, the lighter contacts 478 and 480 located on the support member 476 come into contact with the power contacts 14 and 16, respectively, and establish the first electrical connection between the outputs 446 and 448 of the inverter 422 and the power contacts 14 and 16, respectively. As the card 10 is inserted, the bottom edge 30 of the card 10 also pushes the spring region 466 of the lever switch 460 down until the contact region 468 touches and electrically connects the two electrodes 470 and 472, thereby establishing the second electrical connection between the positive terminal 430 of the battery 420 and the positive input 442 of the inverter 422. However, AC electrical energy is not coupled to the power contacts 14 and 16 from the inverter 422 until a current flow is established in the SCR 496. The current flow is established in the SCR 496 when the user moves the momentary switch 486 into the ON position, causing the momentary switch 486 to connect the terminals 488 and 490. If the second electrical connection has been established when the card is inserted onto the lever 460, when the user presses the momentary switch 486, a gate voltage is established across the resistor 498 sufficient to turn the SCR 496 on and allow current to pass through the anode 461 to the cathode 463 which causes an AC voltage to be developed across outputs 446 and 448 of the inverter 422 sufficient to illuminate the card 10. Once the SCR 496 is turned on and the current is flowing through the SCR 496, the user can release the momentary switch 486 from the ON position and the SCR 496 remains conducting and the card remains illuminated. Also, the resistor 498 will prevent the SCR 496 from turning on unintentionally.

When the user is done viewing the card 10 in the lighter 400, the user lifts the card 10 out of the lighter 400. Lifting the card 10 in an upward manner through the slot 408 moves the lever switch 460 up, and the contact region 468 separates from the first and second electrodes 470 and 472 and no longer electrically connects the electrodes 470 and 472. As a result, the second electrical connection is broken, and AC electrical energy is no longer supplied to the lighter contacts 478 and 480 from the inverter 422 while the first electrical connection is still maintained. As the card 10 is further lifted upward, the power contacts 14 and 16 of the card 10 separate from the lighter contacts 478 and 480 and break the first electrical connection. Because there is no voltage developed across the lighter contacts 478 and 480 when the power contacts 14 and 16 are separated from the lighter contacts 478 and 480, respectively, there is reduced arcing. Also, when the second electrical connection is broken, the current flow through the SCR 496 ceases and the SCR 496 turns off and no current flows from the anode 461 to the cathode 463.

Figure 22:
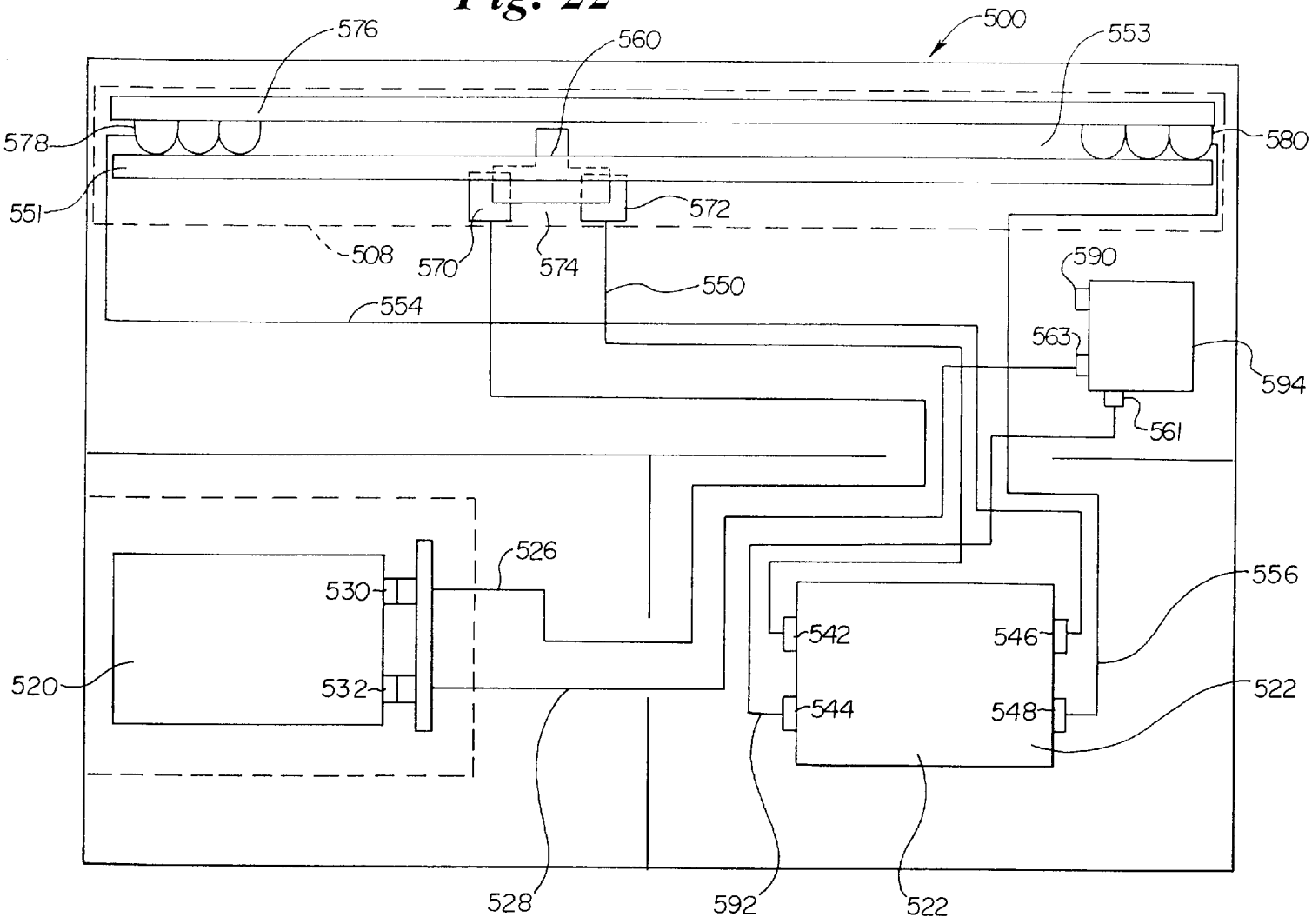
FIG. 22 is a layout diagram of a card lighter according to a fifth embodiment of the present invention.
Figure 23:
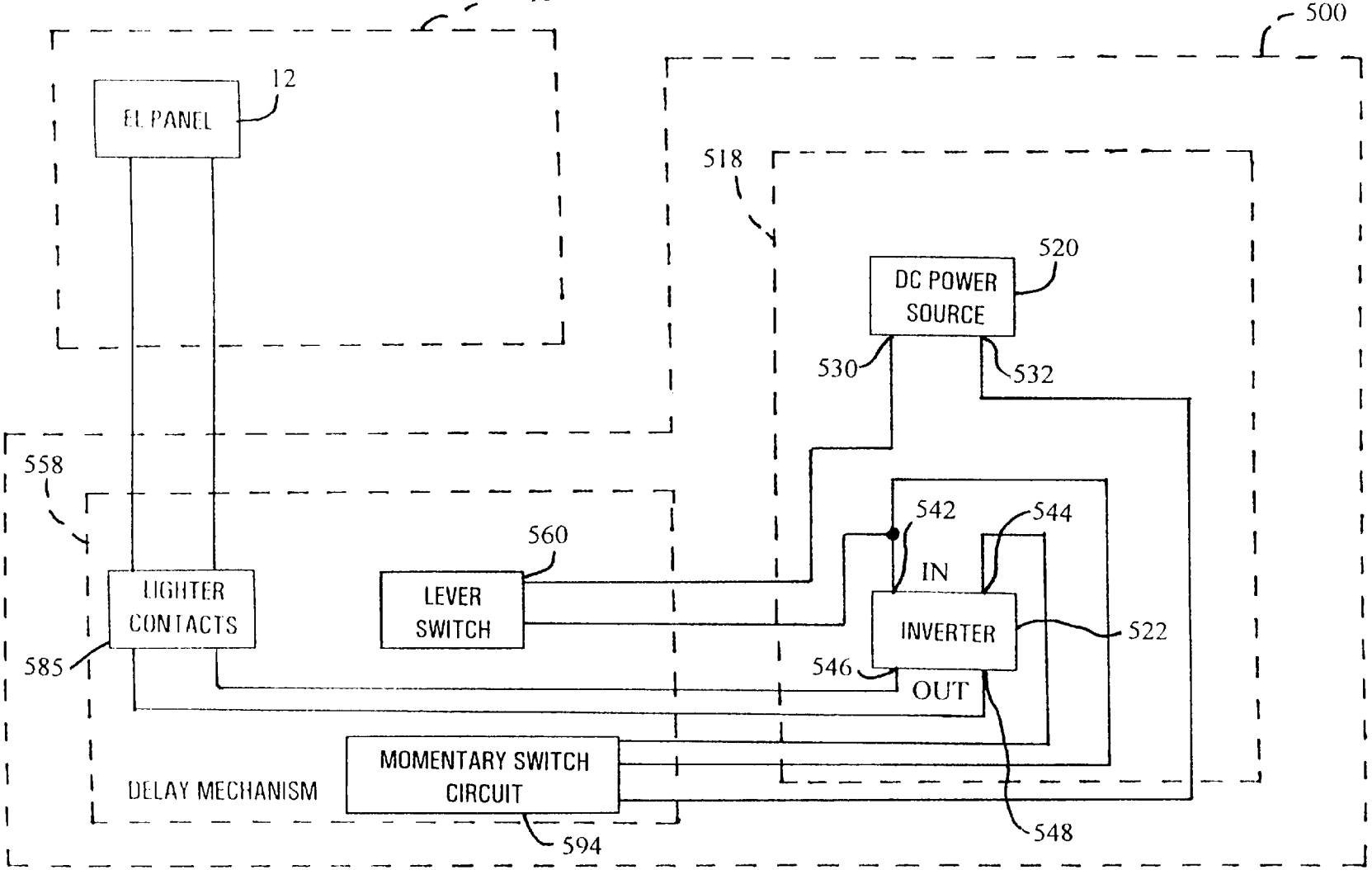
FIG. 23 is a block diagram of the card lighter shown in FIG. 22 connected to an internally illuminatable card according to the present invention.
Figure 24:
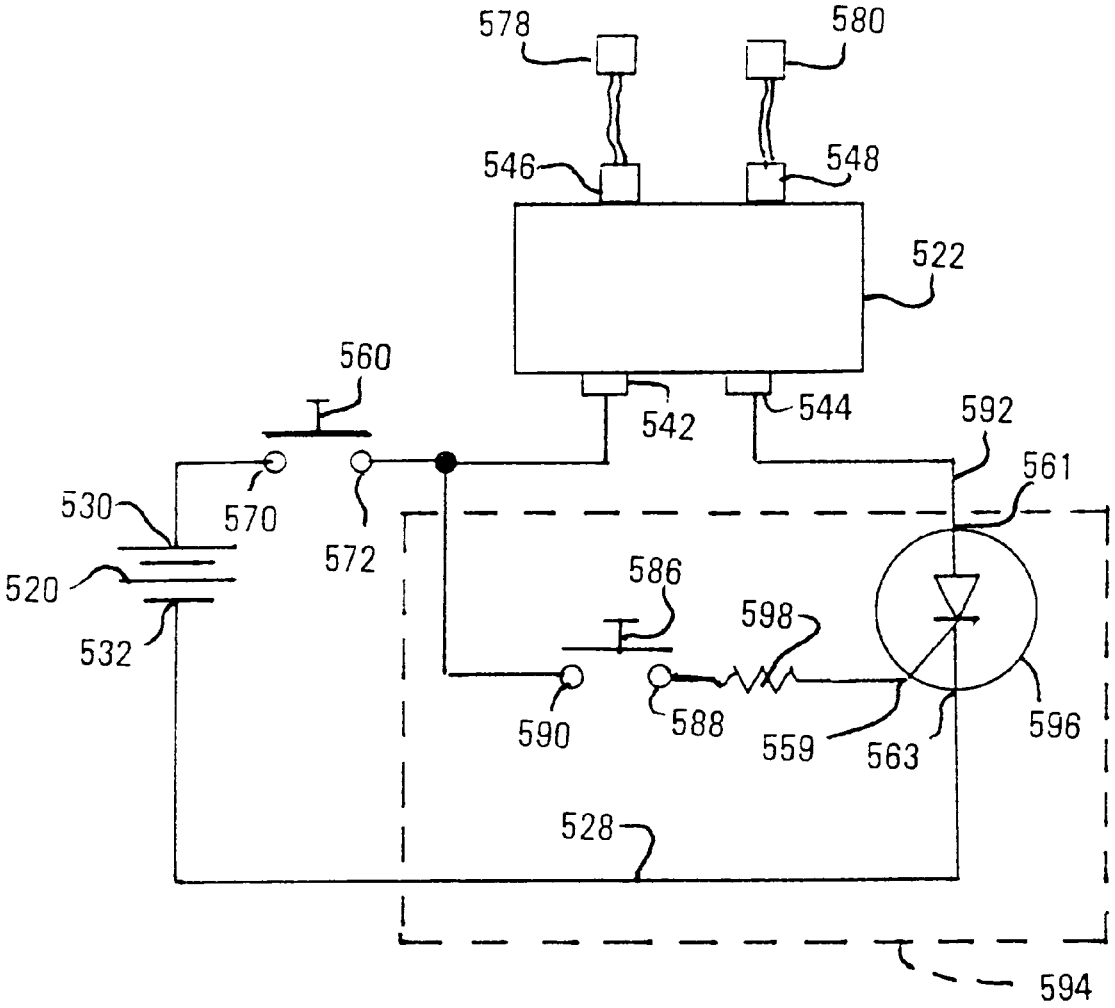
FIG. 24 is a circuit diagram of a momentary switch connected to a power supply circuit and inverter of the card lighter shown in FIGS. 22–23.
Figure 25:
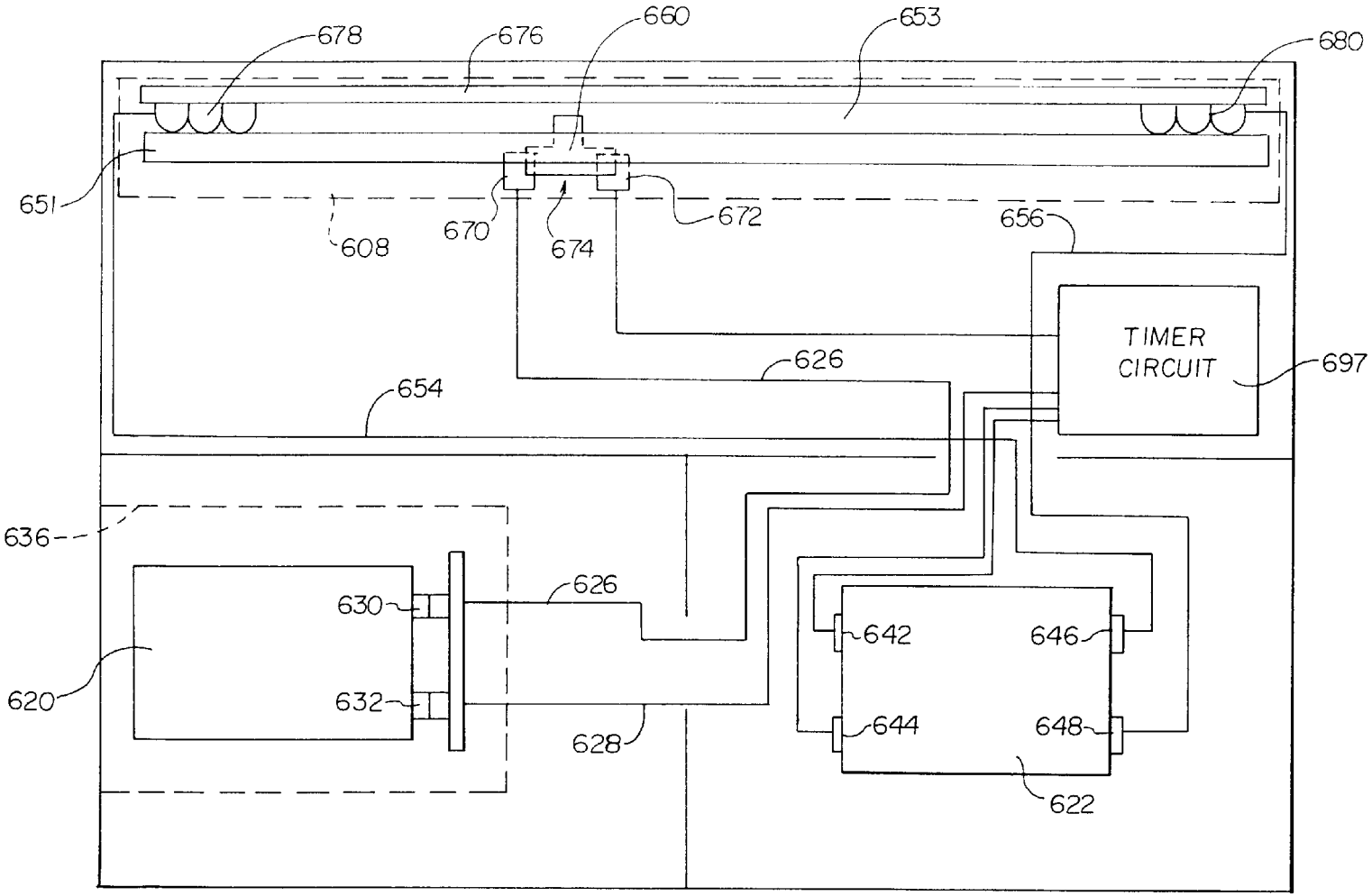
FIG. 25 is a layout diagram of a card lighter according to a sixth embodiment of the present invention.
Figure 26:
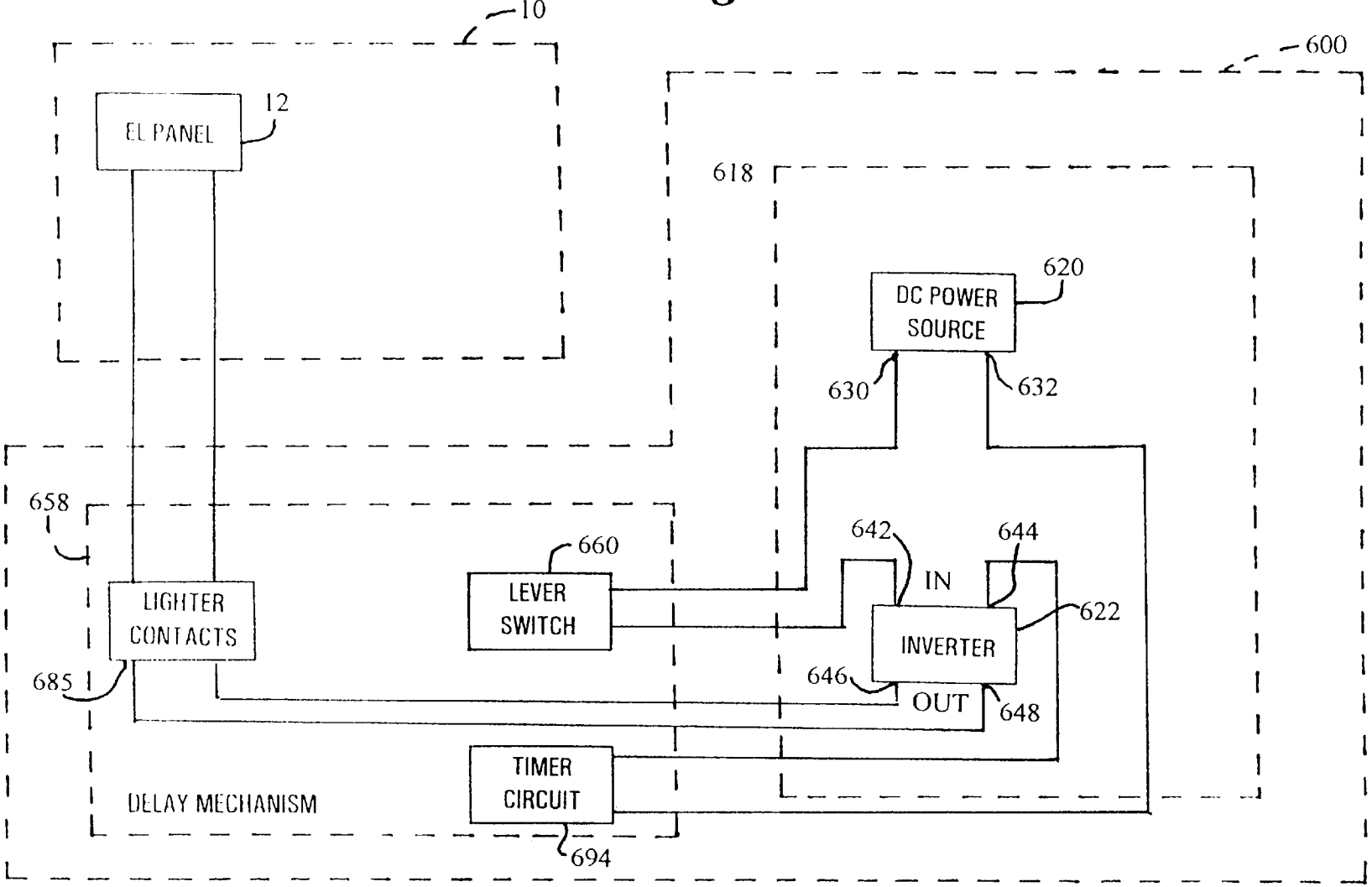
FIG. 26 is a block diagram of the card lighter shown in FIG. 25 connected to an internally illuminatable card according to the present invention.

FIGS. 22–24 show a fifth embodiment of a card lighter 500 that can illuminate card 10 shown in FIGS. 1–4 or an illuminatable card having an alternative design that has power contacts and no switch terminal on the card. Except as is described below, the card lighter 500 is similar to the card lighter 400 and can be fabricated using similar processes. Elements of card lighter 500 that correspond to elements of lighter 400 are referred to with numerals that are incremented by 100 (e.g. the housing 402 of the lighter 400 corresponds to a housing 502 of the lighter 500).

The card lighter 500 has a momentary switch circuit 594 (shown in detail in FIG. 24) that has a momentary switch 586. Terminal 590 of momentary switch 586 is electrically connected to the electrode 572 of lever switch 560, and terminal 588 (shown in FIG. 24) of momentary switch 586 is electrically connected to one terminal of a resistor 598. The other terminal of the resistor 598 is electrically connected to a gate 559 of a SCR 596. The SCR 596 also has an anode 561 that is electrically connected to the negative input 544 of the inverter 522 by the wire 592 and a cathode 563 that is electrically connected to the negative terminal 532 of the battery 520 by the wire 528. A suitable SCR 596 is the NTE 5402 commercially available from NTE Electronics, Inc. A suitable resistor 598 has a resistance of 1 kiloohms and is widely available from suppliers such as YAGEO, of Hsin Tien, Taipei, Taiwan.

Card lighter 500 is used in a similar manner as card lighter 400, wherein a card 10 is inserted into the lighter 500 with surface 20 of card 10 facing support member 576. A first electrical connection between the outputs 546 and 548 of the inverter 522 and the power contacts 14 and 16, respectively, is established, followed by the establishment of a second electrical connection between the positive terminal 530 of the battery 520 and the positive input 542 of the inverter 522. As in the card lighter 400, AC electrical energy is not coupled to the power contacts 14 and 16 from the inverter 522 until a current flow is established in the SCR 596. The current flow is established in the SCR 596 when the user moves the momentary switch 586 into the ON position and electrically connects the momentary switch 586 to the terminals 588 and 590. If the second electrical connection has been established when the card is inserted onto the lever 560, when the user presses the momentary switch 586, a gate voltage is established across the resistor 598 sufficient to turn the SCR 596 on and allow current to pass through the anode 561 to the cathode 563 thereby causing an AC voltage to be developed across the outputs 546 and 548 of the inverter 522 sufficient to illuminate the card 10. Once the SCR 596 is turned on and the current is flowing through the SCR 596, the user can release the momentary switch 586 from the ON position and the SCR 596 remains conducting.

When the user is done viewing the card 10 in the lighter 500, the user lifts the card 10 out of the lighter 500. Lifting the card 10 in an upward manner through the slot 508 moves the lever switch 560 up, and the contact region 568 separates from the first and second electrodes 570 and 572 and no longer electrically connects the electrodes 570 and 572. As a result, the second electrical connection is broken, and AC electrical energy is no longer supplied to the lighter contacts 578 and 580 from the inverter 522 while the first electrical connection is still maintained. As the card 10 is further lifted upward, the power contacts 14 and 16 of the card 10 separate from the lighter contacts 578 and 580 and break the first electrical connection. Because there is no voltage developed across the lighter contacts 578 and 580 when the power contacts 14 and 16 are separated from the lighter contacts 578 and 580, there is reduced arcing. Also, when the second electrical connection is broken, the current flow through the SCR 596 ceases and the SCR 596 turns off and no current flows from the anode 561 to the cathode 563.

FIGS. 25–28 show a sixth embodiment of a card lighter 600 that can illuminate card 10 shown in FIGS. 1–4 or an illuminatable card according to the present invention having an alternative design that includes power contacts but not a switch terminal on the card. Except as described below, the card lighter 600 is similar to the card lighter 400 and can be fabricated using similar processes. Elements of the lighter 600 that correspond to elements of the lighter 400 and are referred to with numerals that are incremented by 200 (e.g. the housing 402 of the lighter 400 corresponds to a housing 602 of the lighter 600).

Figure 27:
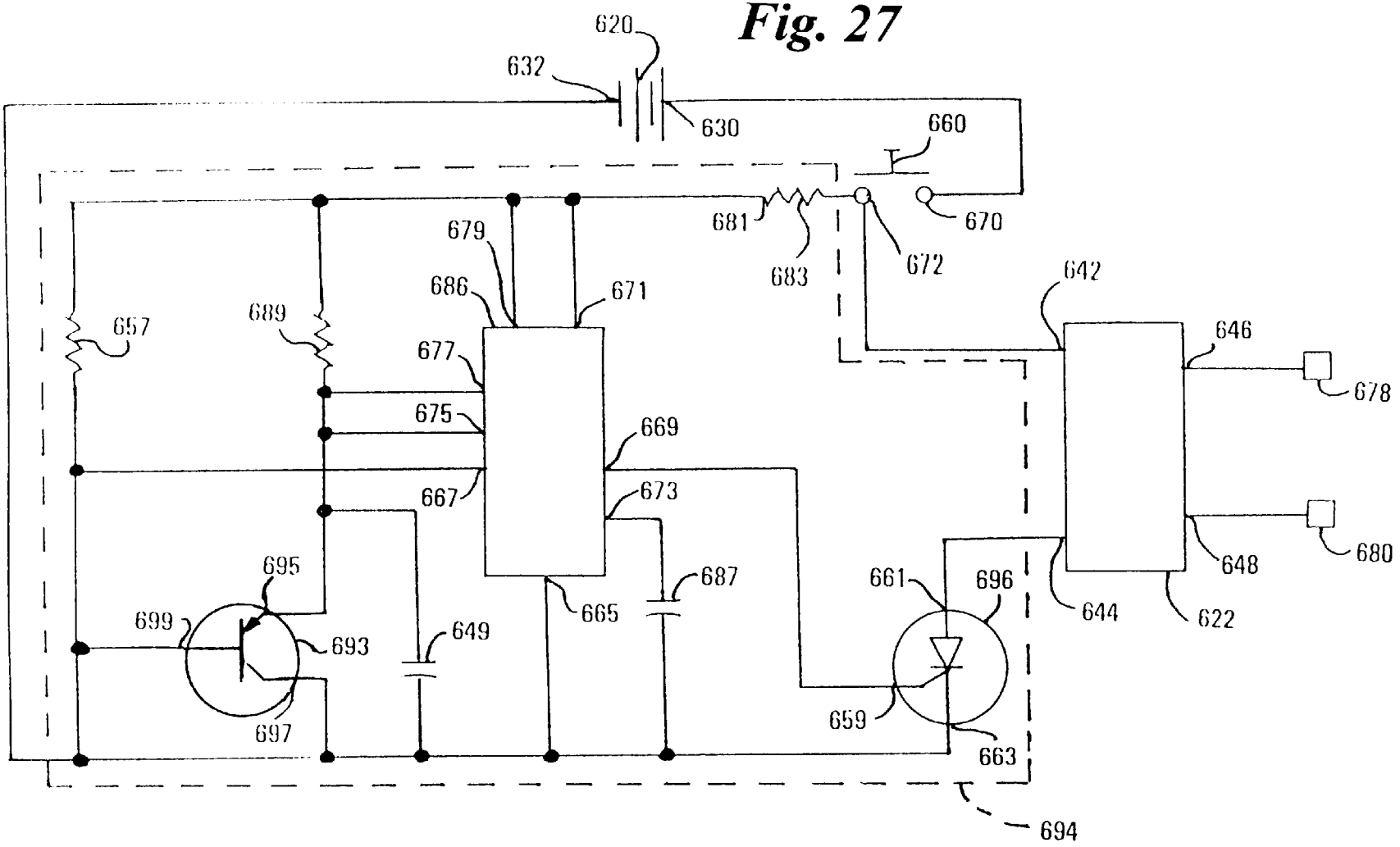
FIG. 27 is a circuit diagram of a timer circuit connected to a power supply circuit and inverter of the card lighter shown in FIGS. 25–26.
Figure 28:
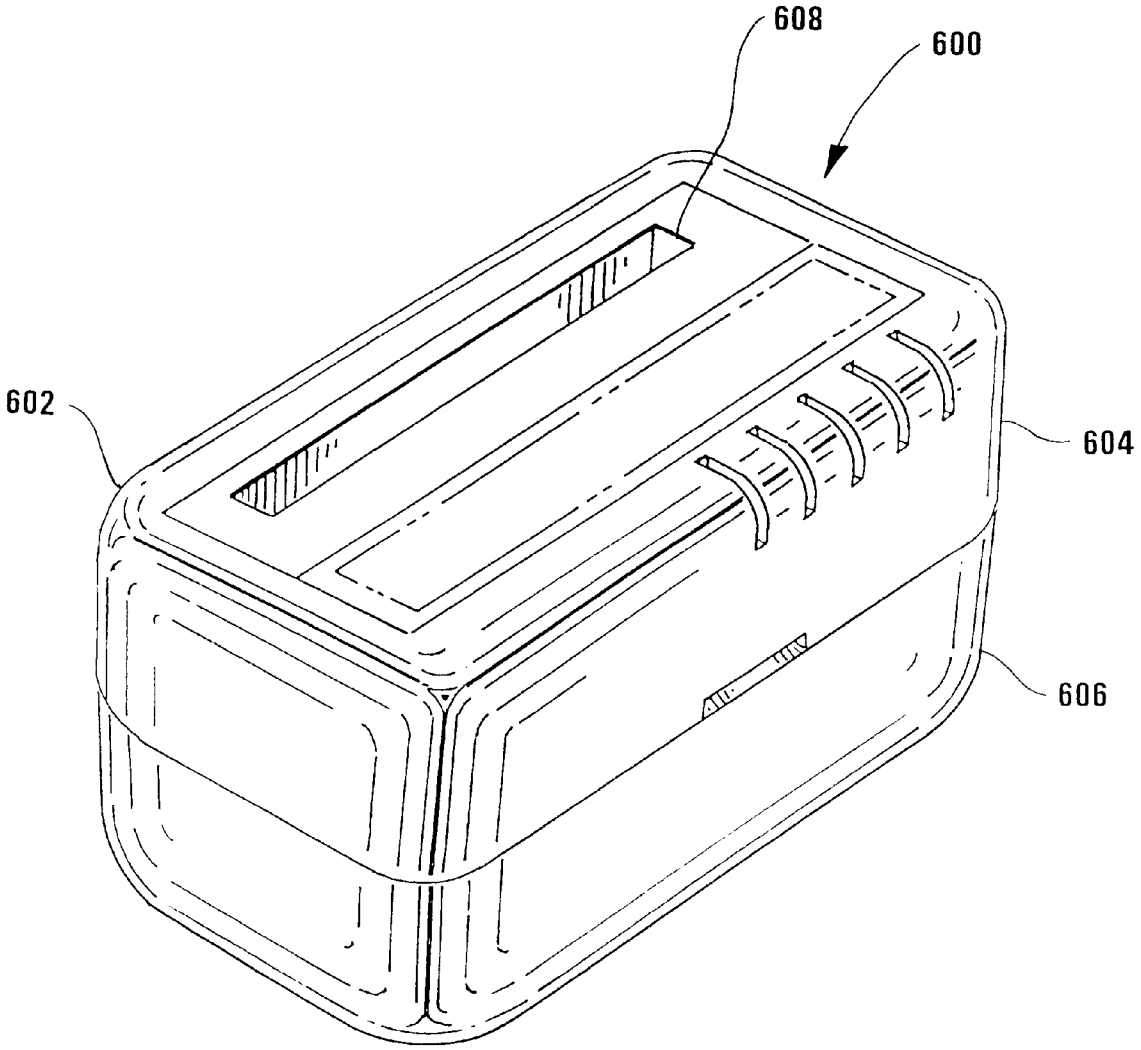
FIG. 28 is a perspective view of the card lighter shown in FIGS. 25–26.

The delay mechanism 658 of lighter 600, instead of making use of a user-activated momentary switch as in card lighters 400 and 500, uses a timer circuit 694. Timer circuit 694 is of conventional design and allows a current to flow into the inverter 622 after a predetermined time (e.g. 0.5 seconds) has passed. The timer circuit 694, for example, can include a conventional timer 686 such as the NE555 timer commercially available from Radio Shack of Fort Worth, Tex. As shown in FIG. 27, timer 686 has a ground terminal 665, a trigger terminal 667, an output terminal 669, a reset terminal 671, a control voltage terminal 673, a threshold terminal 675, a discharge terminal 677, and a $V_{CC}$ terminal 679. The ground and trigger terminals 665 and 667 are electrically connected to the negative terminal 632 of the battery 620. The output terminal 669 is electrically connected to a SCR 696 having a gate 659, an anode 661, and a cathode 663. More specifically, the output terminal 669 is electrically connected to the gate 659 of the SCR 696. The anode 661 of the SCR 696 is electrically connected to the negative input 644 of the inverter 622 and the cathode 663 is electrically connected to the negative terminal 632 of the battery 620. A suitable SCR 696 is the SCR 5402 commercially available from NTE Electronics, Inc. The reset and $V_{CC}$ terminals 671 and 679 are electrically connected to a first end 681 of a first resistor 683. A suitable resistor 683 has a resistance of 470 ohms. The other end of the resistor 683 is electrically connected to the positive input 642 of the inverter 622 and the electrode 672 of the lever switch 660. The other electrode 670 of the switch 660 is electrically connected to the positive terminal 630 of the battery 620. The control voltage terminal 673 is electrically connected to one terminal of a first conventional capacitor 687. The other terminal of the capacitor 687 is electrically connected to the negative terminal 632 of the battery 620. A suitable capacitor 687 has a capacitance of 0.01 microfarads. The threshold and discharge terminals 675 and 677 are electrically connected to an emitter 695 of a conventional PNP transistor 693. The transistor 693 also has a collector 697 and a base 699 that are electrically connected to the negative terminal 632 of the battery 620. A suitable transistor 693is a 2N3906 type, generally commercially available. Also, a second conventional capacitor 649 has one terminal electrically connected to the emitter 695 of transistor 693 and the other terminal electrically connected to the negative terminal 632 of the battery 620. A suitable capacitor 649 has a capacitance of 3.7 microfarads. The threshold and discharge terminals 675 and 677 are also electrically connected to one end of a second conventional resistor 689. The other end of the resistor 689 is electrically connected to the first end 681 of the first resistor 683. A suitable second resistor 683 has a resistance of 10 kiloohms. A third resistor 657 has one end electrically connected to the negative terminal 632 of the battery 620 and a second end electrically connected to the first end 681 of the first resistor 683. A suitable resistor 657 has a resistance of 4.7 kiloohms.

When the card 10 is inserted into the housing 602 through the slot 608 with surface 20 facing support member 676, the lighter contacts 678 and 680 located on the support member 676 come into contact with the power contacts 14 and 16 and establish the first electrical connection between the outputs 646 and 648 of the inverter 622 and the power contacts 14 and 16, respectively. After the card 10 is inserted, the bottom edge 30 of the card 10 also pushes the spring region 666 of the lever switch 660 down until the contact region 668 touches and electrically connects the two electrodes 670 and 672, thereby establishing the second electrical connection between the positive terminal 630 of the battery 620 and the positive input 642 of the inverter 622. After a predetermined time has passed (e.g. 0.5 seconds) after the first and second electrical connections have been established, the timer 686 establishes a voltage on the output terminal 669 sufficient to turn the SCR 696 on and allow current to flow from the anode 661 to the cathode 663. Consequently, a current flow passes between the timer 686 and the inverter 622, which causes an AC electrical voltage to be established on the inverter outputs 646 and 648. As a result, AC electrical energy is coupled to the power contacts 14 and 16 from the inverter 622 and the card 10 is illuminated.

When the user is done viewing the card 10 in the lighter 600, the user lifts the card 10 out of the lighter 600. Lifting the card 10 is an upward manner through the slot 608 moves the lever switch 660 up and the contact region 668 separates from the first and seconds 670 and 672. As a result, the second electrical connection is broken and an AC electrical voltage is no longer supplied on the inverter outputs 646 and 648. As the card 10 is lifted upward, the power contacts 14 and 16 of the card 10 separate from the lighter contacts 678 and 680 and break the first electrical connection. Because there is no voltage developed across the lighter contacts 678 and 680, there is reduced arcing. Also, when the second electrical connection is broken, the current flow through the SCR 696 ceases and the SCR 696 turns off and no current flows from the anode 661 to the cathode 663.

Figure 29:
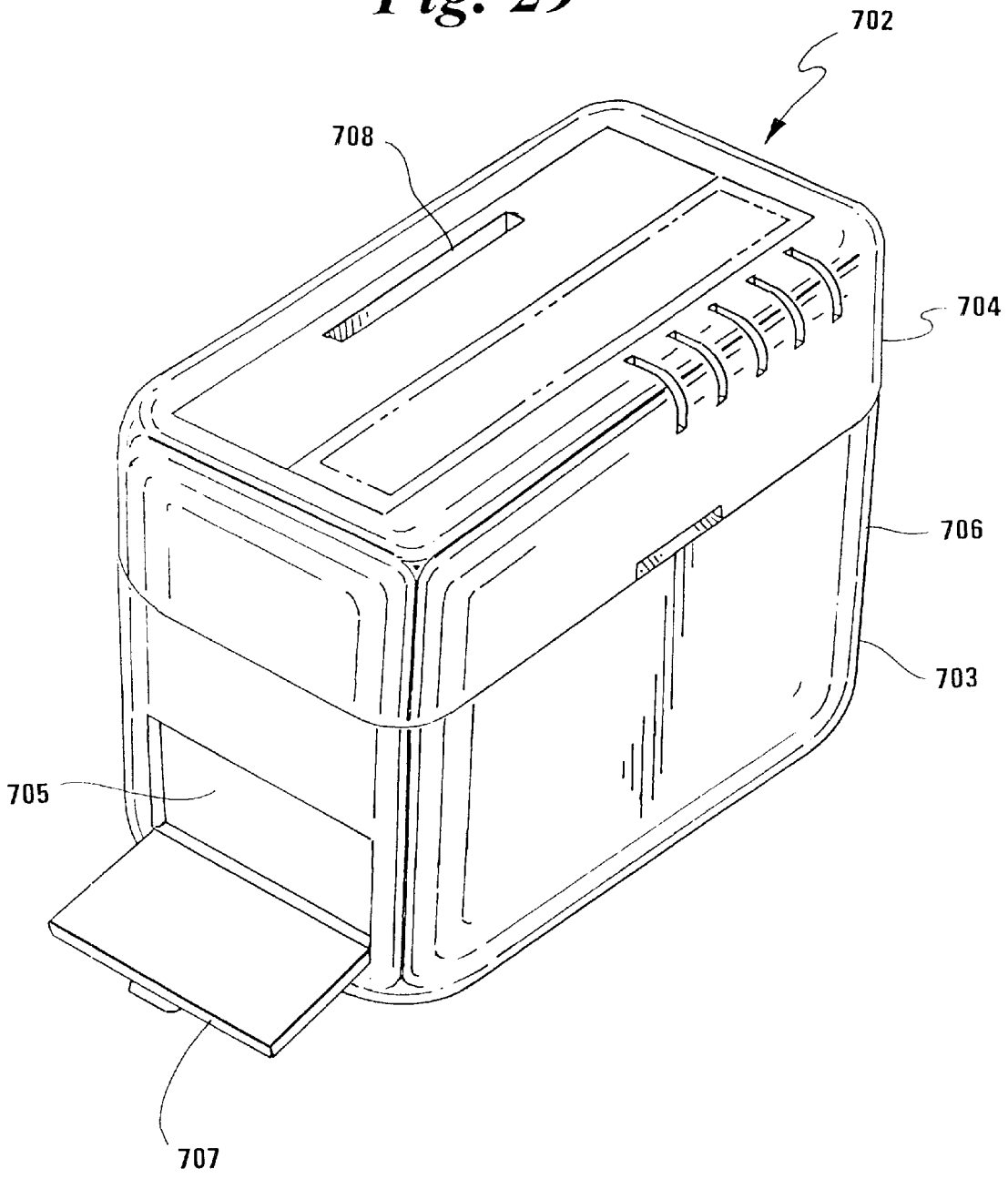
FIG. 29 is an alternative housing having a storage compartment for a card lighter according to the present invention.

FIG. 29 shows an alternative housing 702 that can be used with any of the card lighters 100, 200, 300, 400, 500, or 600. The housing 702 is shaped to surround the componentry of the card lighter and can be formed from upper and lower housing pieces 704 and 706 that are made of plastic using conventional plastic fabrication techniques such as injection molding. The upper housing piece 704 is attached to the lower housing piece 706 to form the housing 702 by conventional fastening means such as a plurality of tamper-resistant screws (not shown). A slot 708 is formed in a surface of the upper housing piece 704 and has a shape that will allow a portion of an illuminatable card to pass through the slot and into the housing 702. A compartment 703 is formed in the lower housing piece 706 that can accommodate one or more internally illuminatable cards while the cards are not being viewed. The cards are inserted into the compartment 703 via an opening 705 formed in the lower housing piece 706. The housing 702 can also include a door 707 that covers the opening 705 to secure cards placed within the compartment 703.

Figure 30:
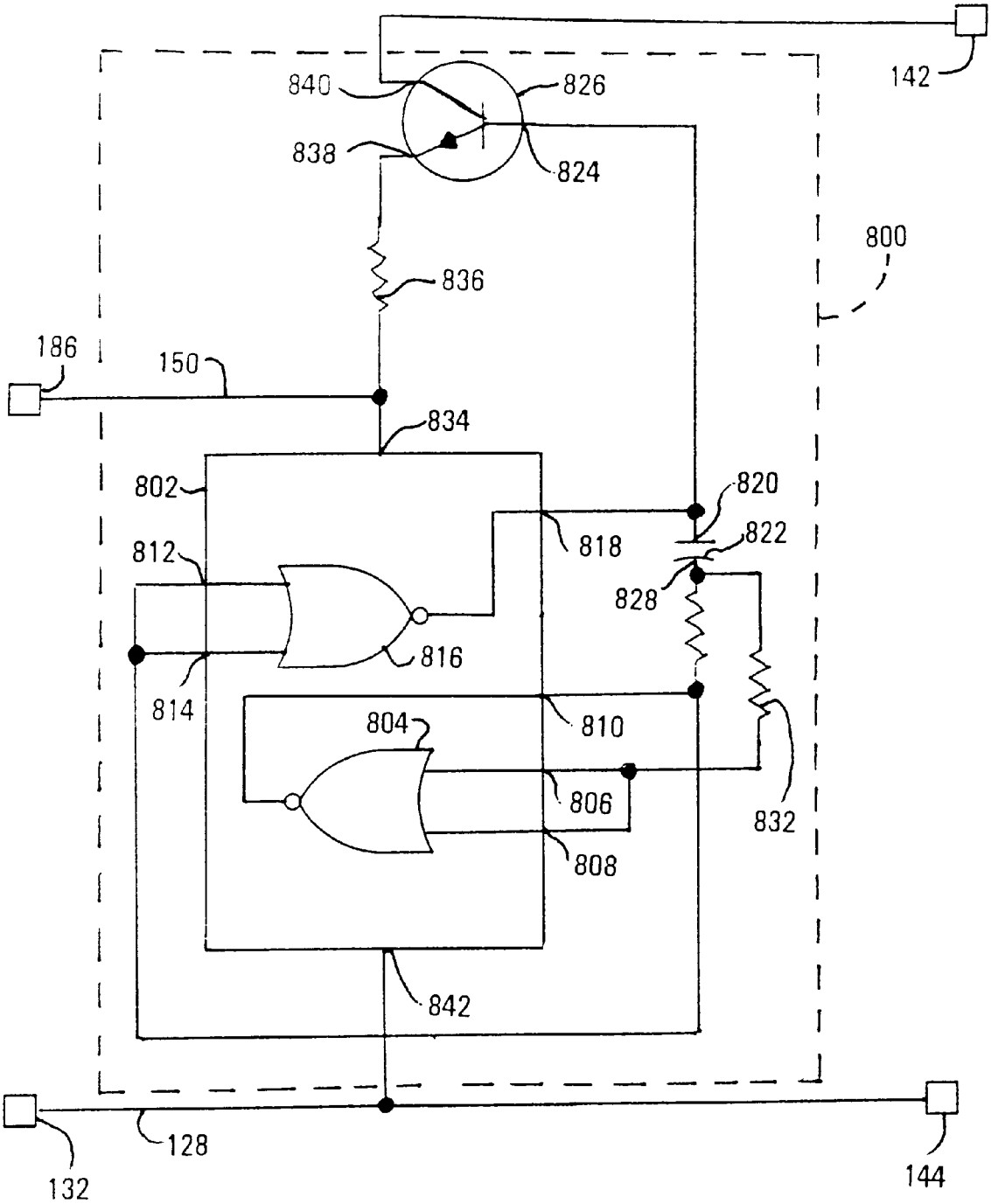
FIG. 30 is a flashing circuit electrically connected to components from the card lighter shown in FIGS. 5–7.

FIG. 30 shows an alternative embodiment of a power supply circuit which includes a flashing circuit 800 between the battery and the inverter that periodically interrupts the flow of current from the battery to the inverter so as to prevent periodically an AC voltage from being developed across the outputs of the inverter. Therefore, the flashing circuit 800 causes a card inserted into a lighter to flash. Flashing circuit 800 is shown in FIG. 30 connected to components of the card lighter 100, although it is to be understood that the flashing circuit 800 can be adapted for use in the power supply circuits of any of the card lighters 100, 200, 300, 400, 500, or 600.

Flashing circuit 800 includes a standard, commercially available 4001 QUAD NOR gate integrated circuit 802. Integrated circuit 802 has a first NOR gate 804 having first and second inputs 806 and 808 and an output 810. Output 810 is electrically connected to first and second inputs 812 and 814 of a second NOR gate 816. Second NOR gate 816 has an output 818 electrically connected to a first end 820 of a capacitor 822 and to a base 824 of a transistor 826. The capacitor 822 has a second end 828 that is electrically connected to one end of a first resistor 830 that has a second end electrically connected to the output 810 of the first NOR gate 804 The second end 828 of the capacitor 822 is also electrically connected to one end of a second resistor 832 that has a second end electrically connected to the first and second inputs 806 and 808 of the first NOR gate 804. The integrated circuit 802 also has a $V_{CC}$ terminal 834 that is electrically connected to the wire 150 from the lighter switch terminal 186 and a first end of a third resistor 836 that has a second end electrically connected to an emitter 838 of the transistor 826. The transistor 826 also has a collector 840 that is electrically connected to the positive input 142 of the inverter 122 (not shown in FIG. 30). The integrated circuit 802 also has a $V_{SS}$ terminal 842 that is electrically connected to the negative terminal 132 of the battery 120 (not shown in FIG. 30) and the negative input 144 of the inverter 122. A suitable capacitor 822 is of conventional design and has a capacitance of 4.7 microfarads. A suitable first resistor 830 is of conventional design and has a resistance of 100 kiloohms, a suitable second resistor 832 is of conventional design and has a resistance of 1 megohm, and a suitable third resistor 836 is of conventional design and has a resistance of 1 kiloohm. A suitable transistor 826 is the generally, commercially available 2N2222 type transistor.

Figure 31:
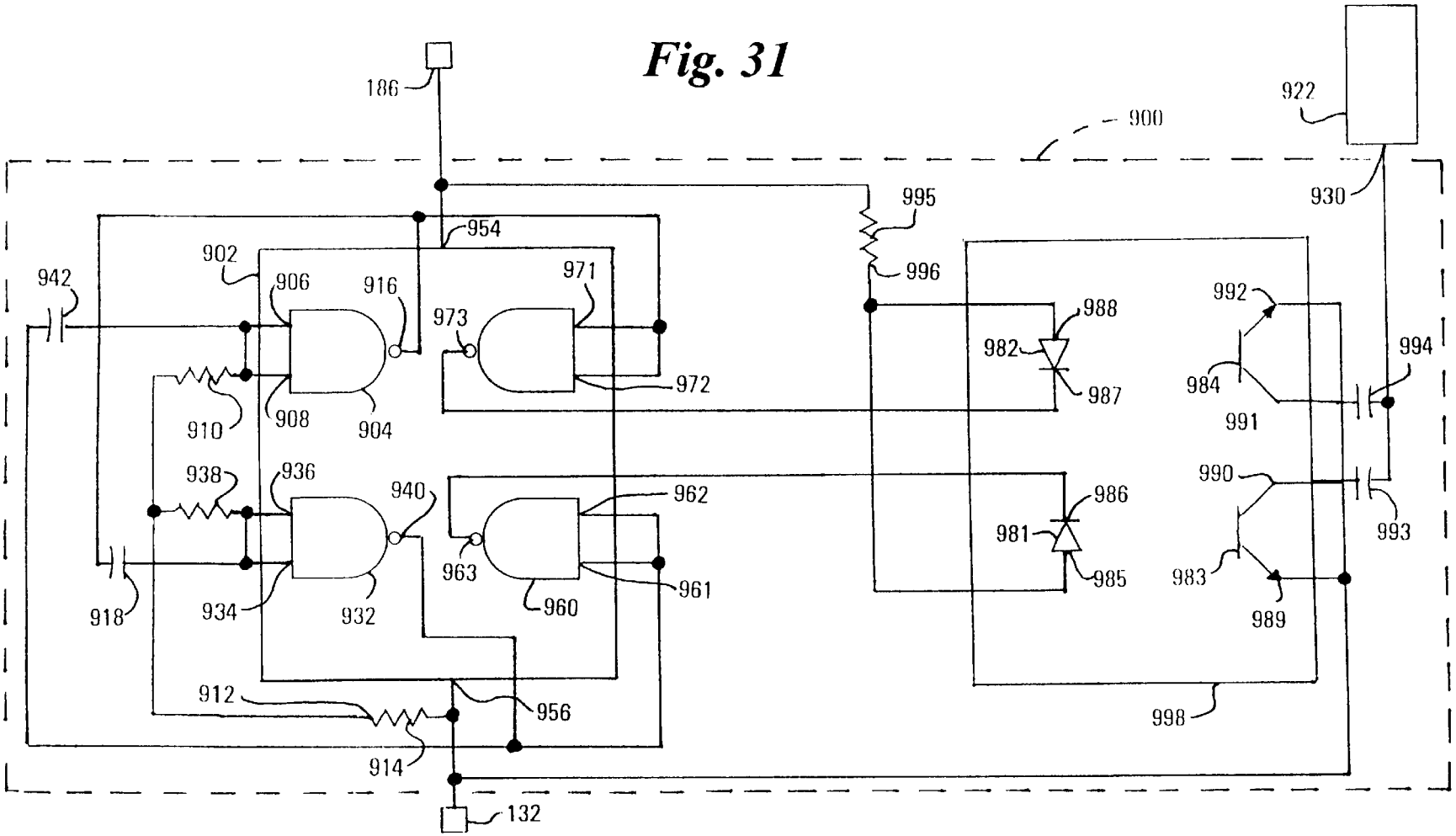
FIG. 31 is a frequency-varying circuit electrically connected to components from the card lighter shown in FIGS. 5–7.

FIG. 31 shows yet another alternative embodiment of a power supply circuit which includes a frequency-varying circuit 900 connected to a clock frequency terminal 930 of an inverter 922 in order to change the frequency of the AC voltage output by the inverter 922. Inverter 922 is designed so that the capacitance coupled to the clock frequency terminal 930 of the inverter 922 determines the output frequency of the inverter 922. The frequency-varying circuit 900 shown in FIG. 31 produces an output signal that alternates (at the rate of about 2 Hz) between two output frequencies of about 400 Hz and about 600 Hz. Therefore, the frequency-varying circuit 900 causes the hue and intensity of the light emitted by a card inserted into a card lighter to alternate between two states. Frequency-varying circuit 900 is shown in FIG. 31 connected to components of the card lighter 100, although it is to be understood that the frequency-varying circuit 900 can be adapted for use in the power supply circuits of any of the card lighters 100, 200, 300, 400, 500, or 600.

Frequency-varying circuit 900 includes a standard, commercially available 4011 QUAD NAND gate integrated circuit 902. Integrated circuit 902 has a first NAND gate 904 with first and second inputs 906 and 908 that are both electrically connected to a first end of a first resistor 910. Resistor 910 has a second end that is electrically connected to a first end 912 of a second resistor 914. The second end of the resistor 914 is electrically connected to the negative terminal 132 of the battery 120 (not shown in FIG. 31). The first NAND gate 904 also has an output 916 that is electrically connected to one end of a first capacitor 918. The output 916 is also electrically connected to first and second inputs 971 and 972 of a third NAND gate 970. The other end of the capacitor 918 is electrically connected to a first input 934 of a second NAND gate 932. The second NAND gate 932 also has a second input 936, and the first and second inputs 934 and 936 are both electrically connected to one end of a third resistor 938 that has a second end electrically connected to the first end 912 of the second resistor 914. The second NAND gate 932 also has an output 940 that is electrically connected to one end of a second capacitor 942 that has a second end that is electrically connected to first and second inputs 906 and 908 of the first NAND gate 904. The output 940 of the second NAND gate 932 is also electrically connected to first and second inputs 961 and 962 of a fourth NAND gate 960. The fourth NAND gate 960 also has an output 963 that is electrically connected to a cathode end 986 of a first IR emitter 981. The first IR emitter 981, as well as a second IR emitter 982 and first and second photo-transistors 983 and 984, is part of a standard NPN dual transistor optoisolater 998 (commercially available as part no. 3086 from NTE Electronics). The third NAND gate 970 also has an output 973 that is electrically connected to a cathode end 987 of the second IR emitter 982. The anode end 988 of the second IR emitter 982 is electrically connected to a first end 996 of a fourth resistor 995. A second end of resistor 995 is electrically connected to the lighter switch terminal 186. The anode end 985 of first IR emitter 981 is electrically connected to the first end 996 of resistor 995. An emitter terminal 989 of the first photo-transistor 983 is electrically connected to the negative terminal 132 of the battery 120. An emitter terminal 992 of the second photo-transistor 984 is also electrically connected to the negative terminal 132 of the battery 120. The collector terminal 990 of the photo-transistor 983 is electrically connected to one end of a third capacitor 993. The other end of capacitor 993 is electrically connected to the clock frequency terminal 930 of the inverter 922. A collector terminal 991 of the phototransistor 984 is electrically connected to one end of a fourth capacitor 994. The other end of the capacitor 994 is electrically connected to the clock frequency terminal 930 of the inverter 922. The integrated circuit 902 also has a $V_{CC}$ terminal 954 and a $V_{SS}$ terminal 956. The $V_{CC}$ terminal 954 is electrically connected to the lighter switch terminal 186, and the $V_{ss}$ terminal 956 is electrically connected to the negative terminal 132 of the battery 120. Suitable first and third resistors 910 and 938 are of conventional design and both have a resistance of 4.7 kiloohms, and a suitable second resistor 914 is of conventional design and has a resistance of 1 kiloohm. In addition, a suitable fourth resistor 995 is of conventional design and has a resistance of 1 kiloohm. Suitable first and second capacitors 918 and 942 are of conventional design and both have a capacitance of 100 microfarads. Third capacitor 993 is of conventional design and has a capacitance of 6.8 nanofarads, and fourth capacitor 994 is of conventional design and has a capacitance of 12.1 nanofarads. A suitable inverter 922 is the D358 pumping inductor-based inverter from Durel Corporation.

Although the present invention has been described with reference to preferred embodiments, those skilled in the art will recognize that changes may be made in form and detail without departing from the spirit and scope of the invention. For example, the card lighter could be adapted to illuminate several internally illuminatable cards (e.g., formed into a binder cover and designed to light cards placed in the pages of the binder) and/or to have a decorative shape (e.g., a baseball field with openings in the housing shaped to receive a plurality of illuminatable cards and with the cards arranged at the various baseball positions on the field).

What is claimed is:

1. An internally illuminatable card, comprising:

(a) an electroluminescent panel;

(b) an image overlay on a surface of the electroluminescent panel;

(c) a plurality of power contacts in electrical communication with the electroluminescent panel and located on the card so that electrical energy sufficient to illuminate the electroluminescent panel and the image overlay can be selectively coupled to the card; and (d) a card switch terminal located on the card such that electrical energy sufficient to illuminate the electroluminescent panel and the image overlay can be selectively coupled to the electroluminescent panel through the power contacts when enabled by the card switch terminal, wherein the power contacts are accessible from at least one surface of the card and are located adjacent to an edge of the card, and the card switch terminal is located on at least one surface of the card proximal to the edge of the card such that the card switch terminal is farther from the edge than the power contacts, so that when the card is inserted into a card lighter, the power contacts touch corresponding lighter contacts in the card lighter before the card switch terminal touches corresponding lighter switch terminals in the card lighter, and so that when the card is removed from the card lighter, the power contacts separate from the corresponding lighter contacts in the card lighter after the lighter switch terminal has separated from the lighter switch terminals in the card lighter.

2. The internally illuminatable card of claim 1, wherein the card has the shape of a trading card.

3. The internally illuminatable card of claim 1, wherein the image overlay is formed integrally with the electroluminescent panel.

4. A card lighter, comprising:

(a) a housing shaped to receive and support an internally illuminatable card so that at least one surface of the card is viewable;

(b) a power supply circuit located within the housing and adapted to supply to the card electrical energy sufficient to illuminate the card;

(c) a plurality of lighter contacts in electrical communication with the power supply circuit and operationally disposed within the housing so that the lighter contacts are adapted to contact corresponding power contacts on the card in order to establish a first electrical connection between the power supply circuit and the card; and (d) a delay mechanism located within the housing and in electrical communication with the power supply circuit and the lighter contacts that is capable of establishing a second electrical connection so that:

(i) when the card is inserted into the lighter, an electrical circuit between the power supply circuit and the card is completed by the second electrical connection after the first electrical connection has been established so that arcing is reduced; and (ii) when the card is removed from the lighter, the electrical circuit is broken by breaking the second electrical connection before the first electrical connection is broken so that arcing is reduced.

5. The card lighter of claim 4 wherein the power supply circuit comprises:

(a) a DC power source removably located within the housing and having negative and positive terminals; and (b) an inverter in electrical communication with the DC power source and the lighter contacts, the inverter having negative and positive input terminals, and operable to supply AC electrical energy sufficient to illuminate an electroluminescent panel located in the card when the card is inserted in the lighter.

6. The card lighter of claim 5, wherein the DC power source includes a battery.

7. The card lighter of claim 5, wherein the inverter provides an output AC voltage with a frequency in the range of about 60 Hz to about 5,000 Hz.

8. The card lighter of claim 5, wherein the power supply circuit includes a frequency changing circuit that varies the frequency of the output AC voltage provided by the inverter.

9. The card lighter of claim 5, wherein a surface of the housing is shaped so as to define a first slot having a shape effective to receive at least a marginal portion of the card.

10. The card lighter of claim 9 wherein the delay mechanism comprises:

(a) a lever switch positioned beneath the first slot and adapted so that the lever switch establishes the second electrical connection between the DC power supply and the inverter when the marginal portion of the card is inserted into the lighter and breaks the second electrical connection when the marginal portion of the card is removed from the lighter; and (b) a momentary switch circuit including a momentary switch capable of establishing a current flow in the momentary switch circuit after the first and second electrical connections have been established so that electrical energy sufficient to illuminate the electroluminescent panel is coupled to the card.

11. The card lighter of claim 10, wherein the momentary switch circuit further includes a resistor and a silicon controlled rectifier having an anode, a cathode, and a gate, wherein the negative terminal of the DC power source is in electrical communication with the cathode, wherein the anode is electrically connected to the negative input of the inverter circuit, wherein the momentary switch has a first terminal electrically connected to one end of the resistor and a second terminal electrically connected to a positive input terminal of the inverter circuit, and wherein the other end of the resistor is electrically connected to the gate terminal.

12. The card lighter of claim 4, wherein the housing further includes a storage compartment having a shape effective for storing one or more internally illuminatable cards within the housing.

13. A card lighting system comprising:

(a) an internally illuminatable card, including:

(i) an electroluminescent panel;

(ii) an image overlay on a surface of the electroluminescent panel;

(iii) a plurality of power contacts in electrical communication with the electroluminescent panel and accessible through at least one surface of the card; and (b) a card lighter, including:

(i) a housing shaped to receive and support the card so that at least one surface of the card is viewable;

(ii) a power supply circuit located within the housing and adapted to supply to the card electrical energy sufficient to illuminate the card;

(iii) a plurality of lighter contacts in electrical communication with the power supply circuit and operationally disposed within the housing so that the lighter contacts are adapted to contact corresponding power contacts on the card in order to establish a first electrical connection between the power supply circuit and the card; and (iv) a delay mechanism located within the housing and in electrical communication with the power supply circuit and the lighter contacts so that:

(A) when the card is inserted into the lighter, an electrical circuit between the power supply circuit and the card is completed after the first electrical connection has been established so that arcing is reduced; and (B) when the card is removed from the lighter, the electrical circuit is broken before the first electrical connection is broken so that arcing is reduced.

14. A trading card lighter comprising:

(a) a housing adapted to receive, support, and energize an internally illuminatable trading card so that at least one surface of the card is viewable when the card is received in the lighter wherein the card has a plurality of power contacts in electrical communication with the electroluminescent panel and located on the card so that electrical energy sufficient to illuminate the electroluminescent panel and the image overlay can be selectively coupled to the card and wherein the card further has a card switch terminal located on the card such that electrical energy sufficient to illuminate the electroluminescent panel and the image overlay can be selectively coupled to the electroluminescent panel through the power contacts when enabled by the card switch terminal; and (b) a power supply circuit located within the housing and adapted to energize the card when the card is received in the lighter;

(c) corresponding lighter contacts in the card lighter; and (d) corresponding lighter switch terminals in the card lighter wherein the power contacts are accessible from at least one surface of the card and are located adjacent to an edge of the card, and the card switch terminal is located on at least one surface of the card proximal to the edge of the card such that the card switch terminal is farther from the edge than the power contacts, so that when the card is inserted into the card lighter, the power contacts touch the corresponding lighter contacts in the card lighter before the card switch terminal touches corresponding lighter switch terminals in the card lighter, and so that when the card is removed from the card lighter, the power contacts separate from the corresponding lighter contacts in the card lighter after the lighter switch terminal has separated from the lighter switch terminals in the card lighter.

15. A combined trading card and lighter comprising:

(a) an internally illuminatable trading card, having:

(i) an electroluminescent panel;

(ii) an image overlay on a surface of the electroluminescent panel, and having at least a portion which is translucent such that when the electroluminescent panel is energized, light from the electroluminescent panel projects through the translucent portion of the image overlay, and (iii) a plurality of power contacts in electrical communication with the electroluminescent panel and located on the card so that electrical energy sufficient to illuminate the electroluminescent panel and the image overlay can be selectively coupled to the card; and (iv) a card switch terminal located on the card such that electrical energy sufficient to illuminate the electroluminescent panel and the image overlay can be selectively coupled to the electroluminescent panel through the power contacts when enabled by the card switch terminal; and (b) a trading card lighter having:

(i) a housing adapted to receive, support and energize the card so that at least one surface of the card is viewable when the card is received in the lighter, and (ii) a power supply circuit located within the housing and adapted to energize the card when the card is received in the lighter wherein the power contacts are accessible from at least one surface of the card and are located adjacent to an edge of the card, and the card switch terminal is located on at least one surface of the card proximal to the edge of the card such that the card switch terminal is farther from the edge than the power contacts, so that when the card is inserted into a card lighter, the power contacts touch corresponding lighter contacts in the card lighter before the card switch terminal touches corresponding lighter switch terminals in the card lighter, and so that when the card is removed from the card lighter, the power contacts separate from the corresponding lighter contacts in the card lighter after the lighter switch terminal has separated from the lighter switch terminals in the card lighter.

* * * * *